US011007745B2

(12) United States Patent
Ponti

(10) Patent No.: US 11,007,745 B2
(45) Date of Patent: May 18, 2021

(54) CUTTING STATION FOR MAKING TRANSVERSAL CUTS IN A CARDBOARD SHEET AND A MACHINE FOR PACKING AN ARTICLE INTERNALLY OF A CARDBOARD BOX OBTAINED FROM THE CARDBOARD SHEET

(71) Applicant: F.L. AUTO S.R.L., Rome (IT)

(72) Inventor: Giuseppe Ponti, Cerbara-Citta' di Castello (IT)

(73) Assignee: F.L. AUTO S.R.L., Rome (IT)

( * ) Notice: Subject to any disclaimer, the term of this patent is extended or adjusted under 35 U.S.C. 154(b) by 214 days.

(21) Appl. No.: 16/303,569

(22) PCT Filed: May 16, 2017

(86) PCT No.: PCT/IB2017/052878

§ 371 (c)(1),
(2) Date: Nov. 20, 2018

(87) PCT Pub. No.: WO2017/203392

PCT Pub. Date: Nov. 30, 2017

(65) Prior Publication Data

US 2020/0031084 A1 Jan. 30, 2020

(30) Foreign Application Priority Data

May 24, 2016 (IT) ..... 102016000053125

(51) Int. Cl.

| | |
|---|---|
| ***B31B 50/20*** | (2017.01) |
| ***B65B 5/02*** | (2006.01) |
| *B31B 50/25* | (2017.01) |

(52) U.S. Cl.
CPC ..... *B31B 50/20* (2017.08); *B65B 5/024* (2013.01); *B31B 50/25* (2017.08)

(58) Field of Classification Search
CPC . B31B 2100/00; B31B 2110/35; B31B 50/00; B31B 50/024; B31B 50/20;
(Continued)

(56) References Cited

U.S. PATENT DOCUMENTS 6,478,725 B1 * 11/2002 Bengt ..... B26D 1/245 493/59
2014/0206514 A1 * 7/2014 Lootvoet ..... B26D 5/20 493/52

(Continued)

FOREIGN PATENT DOCUMENTS

| | | |
|---|---|---|
| EP | 2883691 A1 | 6/2015 |
| GB | 2295986 A | 6/1996 |
| WO | WO 2014/033635 A1 | 3/2014 |

*Primary Examiner* — Chelsea E Stinson
*Assistant Examiner* — Himchan Song
(74) *Attorney, Agent, or Firm* — R. Neil Sudol; Henry D. Coleman

(57) ABSTRACT

A cutting station receives at an inlet a cardboard sheet having two transverse edges, two longitudinal edges, two longitudinal score lines, and four transverse score lines. The two longitudinal score lines define, a central sector between the two longitudinal score lines and two lateral sectors externally of the two longitudinal folding lines. A conveyor extending from the inlet to an outlet receives the cardboard sheet and conveys it in an advancement direction. For each, and by a flank of each, of the two sides of the conveyor are predisposed a first and a second cutting group configured for making transverse cuts on a respective one of the two lateral sectors of the cardboard sheet at the transverse score lines.

12 Claims, 14 Drawing Sheets

(58) Field of Classification Search
CPC ..... B31B 50/22; B31B 5/00; B31B 5/024; B31B 50/25
USPC ..... 493/56–81
See application file for complete search history.

(56) References Cited

U.S. PATENT DOCUMENTS

| | | | | |
|---|---|---|---|---|
| 2015/0224731 | A1* | 8/2015 | Ponti | B65B 57/12 493/59 |
| 2017/0057190 | A1* | 3/2017 | Toro | B31B 50/00 |

* cited by examiner

CUTTING STATION FOR MAKING TRANSVERSAL CUTS IN A CARDBOARD SHEET AND A MACHINE FOR PACKING AN ARTICLE INTERNALLY OF A CARDBOARD BOX OBTAINED FROM THE CARDBOARD SHEET

FIELD OF THE INVENTION

The present invention relates to the particular technical sector concerning packaging and packing of articles internally of a cardboard box.

In particular the present invention relates to a cutting station for making transversal cuts in a cardboard sheet and a machine for packing an article internally of a cardboard box obtained from the cardboard sheet

DESCRIPTION OF THE PRIOR ART

In the sector of logistics and goods dispatching, the need to pack and package the goods to be dispatched is known, in relative cardboard boxes, with the purpose of protecting and safeguarding them.

The Applicant has realised a special cardboard box for packaging articles, usable for forming a cardboard box with reinforced walls for packing and packaging an article internally thereof, so as to give a special protection and resistance against impacts, and the Applicant also set up special operating procedures for obtaining and realising, from a cardboard sheet, on the basis of the effective dimensions of the article to be packed, a relative cardboard blank and enveloping it about the article so as to package it internally of a box.

The Applicant is the owner of Italian patent application no. 102015000014902 of May 13, 2015 in which the special shape of a cardboard blank for packaging utilisable for the packaging of articles is described.

The cardboard blank (C) for packing disclosed by this patent application, and illustrated in FIG. 1, is obtained from a cardboard sheet, for example undulated, which is cut from a continuous strip of cardboard and then subjected to scoring and cutting operations for achieving the special shape of the illustrated cardboard blank.

A possible sequence of operations with which the cardboard blank illustrated in FIG. 1 can be folded so as to realise a packaging box with a relative article internally thereof is illustrated in the sequence of FIGS. 1A-1F, and also described in the above-mentioned patent application belonging to the Applicant.

The cardboard blank (C) has a quadrilateral shape, which can be for example square or preferably rectangular, with two transversal edges (B1, B2) and two longitudinal edges (BL), and comprises, at a first transversal edge (B1) and a second transversal edge (B2), two longitudinal folding lines (L1, L2), parallel to one another: the two longitudinal score lines (L1, L2) identify, in the cardboard sheet, a central sector (SC) and two lateral sectors (SL1, SL2).

Usually, the articles to be packed and dispatched are either predisposed in containers having a parallelepiped shape, with a quadrangular or rectangular base.

The two longitudinal score lines (L1, L2) are realised on the cardboard blank (C) distanced from one another on the basis of the effective dimensions of the base of the article to be packed, for example on the basis of the length of the base of the article.

The cardboard blank (C) further comprises four transversal score lines (T1, T2, T3, T4), parallel to one another and such as to identify, on the central sector (SC) of the cardboard blank (C) and between the two transversal edges (B1, B2), five portions (P1, P2, P3, P4, P5).

The four transversal score lines (T1, T2, T3, T4)) are made so as to be distanced from one another as a function of the effective dimensions of the article to be packed, in particular on the basis of the width of the base of the article, the width (L*) of the upper face and the height (H) of the flanks of the article.

In detail, starting from a first transversal edge (B1) of the cardboard blank (C):

- the first transversal score line (T1) and the second transversal score line (T2) are realised such as to be distant from one another by a distance (I) corresponding to the width (I) of the base of the article to be packed; in this way, in the central sector (SC) of the cardboard blank (C) a first portion (P1) is identified that has dimensions corresponding to the base of the article to be packed, and on which first portion (P1) the article can be rested during the packaging operations;
- the first transversal score line (T1) is realised at a distance from the first transversal edge (B1) of the cardboard blank (C) such that it corresponds to the height (H) of a first lateral flank of the article, and in this way, in the central sector (SC) of the cardboard box (C) a second portion (P2) is identified between the first transversal edge (B1) and the first portion (P1), of dimensions corresponding to a first lateral flank of the article to be packed, and destined to cover the first flank of the article during the packaging operations once folded about the first transversal score line (T1);
- the third transversal score line (T3) is realised so as to be distant from the second transversal score line (T2) by a distance corresponding to the height (H) of a second flank of the article, parallel and opposite the first flank; in this way, in the central sector (SC) of the cardboard blank (C) a third portion (P3) is defined, adjacent to the first portion (P1) and on the opposite side to the second portion (P2), having dimensions corresponding to the second lateral flank of the article to be packed, and destined to cover the second flank during the packaging operations once folded about the second transversal score line (T2);
- the fourth transversal score line (T4) is realised so as to be distant from the third transversal score line (T3) by a distance corresponding to the width (L*) of the upper face of the article to be packed, in this way, in the central sector (SC) of the cardboard blank (C), a fourth portion (P4) is defined, adjacent to the third portion (P3), having dimensions corresponding to the upper face of the article to be packed, and destined to cover the upper flank once the third portion (P3) has been folded about the second transversal score line (T2) in order to cover the second flank of the article, and the fourth portion (P4) has been folded about the third transversal score line (T3).

The cardboard blank (C) further comprises, again in the central sector (SC), a fifth portion (P5), adjacent to the fourth portion (P4) and hinged thereto by means of the fourth transversal score line (T4), which constitutes a closing/opening tab (AC) that is destined to be glued to the second portion (P2) of the cardboard blank (C), once the second portion (P2) has been folded to envelop the first flank of the article and the third (P3) and the fourth portion (P4) have been folded respectively to envelop the second flank of the article and the upper face of the article.

The cardboard blank (C) further comprises, for each of the two lateral sectors (SL1, SL2), four transversal cuts (I1, I2, I3, I4) which extend from the longitudinal edges (BL) of the cardboard blank (C) up to arriving at the two longitudinal score lines (L1, L2), and which are made at the four transversal score lines (T1, T2, T3, T4).

In this way, in the two lateral sectors (SL1, SL2) of the cardboard blank, the cardboard blank (C) comprises:

between the first transversal edge (B1) of the cardboard blank (C) and the transversal cuts (I1) made at the first transversal score line (T1): a first reinforcing flap (R1), at a first end of the second portion (P2), foldable on the second portion (P2) about the first longitudinal score line (L1), —and a second reinforcing flap (R2) at a second end of the second portion (P2) and foldable on the second portion (P2) about the second longitudinal score line (L2) so as to at least partly superpose on the first reinforcing flap (R1): the second portion (P2) with the first (R1) and second reinforcing flap (R2) folded thereon and at least partly superposed, constitutes a first lateral closing wall (C1) which is foldable about the first transversal score line (T1) for covering the first lateral flank of the article to be packed (see FIGS. 1A, 1B);

between the transversal cuts (I2) made at the second transversal score line (T2) and the transversal cuts (I3) made at the third transversal score line (T3): a third reinforcing flap (R3) at a first end of the third portion (P3), foldable on the third portion (P3) about the first longitudinal score line (L1), and a fourth reinforcing flap (R4) at a second end of the third portion (P3) and foldable on the third portion (P3) about the second longitudinal score line (L2) so as to at least partly superpose on the third reinforcing flap (R3): the third portion (P3) with the third (R3) and fourth (R4) reinforcing flap folded thereon and at least partly superposed, constitutes a second lateral closing wall (C2) which foldable about the second transversal score line (T2) for covering the second lateral flank, opposite the first flank, of the article to be packed (see FIGS. 1B, 1C);

between the first transversal cuts (I1) made at the first transversal score line (T1) and the transversal cuts (I2) made at the second transversal score line (T2), a first lateral enveloping flap (A1) at a first end of the first portion (P1), foldable about the first longitudinal score line (L1) for covering and enveloping a third lateral flank of the article to be packed, and a second lateral enveloping flap (A2), at a second end of the first portion (P1), foldable about the second longitudinal score line (L2) for covering and enveloping the fourth flank, opposite the third flank, of the article to be packed (see FIGS. 1A, 1B);

between the second transversal cuts (I3) made at the third transversal score line (T3) and the transversal cuts (I4) made at the fourth transversal score line (T4), a fifth reinforcing flap (R5) at a first end of the fourth portion (P4), foldable on the fourth portion (P4) about the first longitudinal score line (L1), and a sixth reinforcing flap (R6) at a second end of the fourth portion (P4) and foldable on the fourth portion (P4) about the second longitudinal score line (L2) so as to at least partly superpose on the fifth reinforcing flap (R5): the fourth portion (P4) with the fifth (R5) and sixth (R6) reinforcing flap folded thereon and at least partly superposed, constitutes an upper closing wall (PS) which is foldable about the third transversal score line (T3), once the second lateral closing wall (C2) has been folded about the second transversal score line (T2) for covering the second lateral flank, for covering the upper face of the article to be packed (see FIGS. 1A, 1F).

The first lateral enveloping flap (A1) comprises a pair of longitudinal folding lines (a, b) parallel and realised at a distance such that on the first flap (A1), between the two folding lines (a, b), a third lateral closing wall (C3) is identified, having a height corresponding to the height of a third lateral flank of the article to be packed, and also a first folding tab (a1), between the third lateral closing wall (C3) and the first longitudinal score line (L1), and a second folding tab (a2), between the third lateral closing wall (C3) and the longitudinal edge (BL) of the cardboard box (C) are identified.

The first folding tab (a1) is destined to superpose on a part of the first portion (P1) once it has been rotated with respect to the first longitudinal score line (L1), so as to form a reinforcing edge, while the second folding tab (a2) is destined, once the third lateral closing wall (C3) has been folded with respect to the first folding tab (a1) for covering the third flank of the article, to be folded with respect to the third lateral closing wall (C3) for covering a portion of the upper face of the article, before the face is covered by the upper closing wall (PS).

Correspondingly, the second lateral enveloping flap (A2) comprises a pair of parallel longitudinal score lines (c, d) parallel and realised at a distance such that on the second flap (A2), between the two folding lines (a, b), a fourth lateral closing wall (C4) is identified, having a height corresponding to the height of a fourth lateral flank of the article to be packed, opposite the third flank, and also a third folding tab (a3), between the fourth lateral closing wall (C4) and the second longitudinal score line (L2), and a fourth folding tab (a4), between the fourth lateral closing wall (C4) and the second longitudinal edge (BL) of the cardboard box (C) are identified.

The third folding tab (a3) is destined to superpose on a part of the first portion (P1) once it has been rotated with respect to the second longitudinal score line (L2), so as to form a reinforcing edge, while the fourth folding tab (a4) is destined, once the fourth lateral closing wall (C4) has been folded with respect to the third folding tab (a3) for covering the fourth flank of the article, to be folded with respect to the fourth lateral closing wall (C4) for covering a portion of the upper face of the article, before the face is covered by the upper closing wall (PS) (see FIGS. 1C-1F).

SUMMARY OF THE INVENTION

The present invention has the aim of providing a cutting station for realising the above-described four transversal cuts in a cardboard sheet on which two longitudinal score lines (L1, L2) are present, and four transversal score lines (T1, T2, T3, T4) so that a central sector (SC) is described in the cardboard sheet, between the two longitudinal score lines (L1, L2), and two lateral sectors (SL1, SL2), external of the two longitudinal score lines (L1, L2).

In particular, the present invention has the aim of providing a cutting station that receives in inlet a cardboard sheet (F) having, in the central sector (SC), between the two longitudinal score lines (L1, L2):

a first portion (P1), between the first transversal score line (T1) and the second transversal score line (T2);

a second portion (P2), between a first transversal edge (B1) of the cardboard sheet and the first transversal score line (T1) adjacent to the first portion (P1) and hinged thereto by the first transversal score line (T1);

a third portion (P3), between the second transversal score line (T2) and the third transversal score line (T3), adjacent to the first portion (P1) and hinged thereto by means of the second transversal score line (T2);

a fourth portion (P4), between the third transversal score line (T3) and the fourth transversal score line (T4), adjacent to the third portion (P3) and hinged thereto by means of the third transversal score line (T3);

a fifth portion (P5) between the fourth transversal score line (T4) and the second transversal edge (B2) of the cardboard sheet, and such as to realise, for each of the two lateral sectors (SL1, SL2), four transversal cuts (I1, I2, I3, I4) at the four transversal score lines (T1, T2, T3, T4).

In this way, the cutting station of the present invention is able to provide at the outlet thereof a cardboard blank (C) such as the one described in the foregoing and illustrated in FIG. 1, i.e. a cardboard blank (C) which comprises, in the two lateral sectors (SL1, SL2):

between the first transversal edge (B1) of the cardboard blank (C) and the transversal cuts (I1) made at the first transversal score line (T1): a first reinforcing flap (R1), at a first end of the second portion (P2), foldable on the second portion (P2) about the first longitudinal score line (L1), and a second reinforcing flap (R2) at a second end of the second portion (P2) and foldable on the second portion (P2) about the second longitudinal score line (L2);

between the transversal cuts (I2) made at the second transversal score line (T2) and the transversal cuts (I3) made at the third transversal score line (T3): a third reinforcing flap (R3) at a first end of the third portion (P3), foldable on the third portion (P3) about the first longitudinal score line (L1), and a fourth reinforcing flap (R4) at a second end of the third portion (P3) and foldable on the third portion (P3) about the second longitudinal score line (L2);

between the first transversal cuts (I1) realised at the first transversal score line (T1) and the transversal cuts (I2) realised at the second transversal score line (T2), a first lateral enveloping flap (A1) at a first end of the first portion (P1), foldable about the first longitudinal score line (L1) for covering and enveloping a third lateral flank of the article to be packed, and a second lateral enveloping flap (A2), at a second end of the first portion (P1), foldable about the second longitudinal score line (L2) for covering and enveloping the fourth flank, opposite the third flank, of the article to be packed;

between the second transversal cuts (I3) made at the third transversal score line (T3) and the transversal cuts (I4) made at the fourth transversal score line (T4), a fifth reinforcing flap (R5) at a first end of the fourth portion (P4), foldable on the fourth portion (P4) about the first longitudinal score line (L1), and a sixth reinforcing flap (R6) at a second end of the fourth portion (P4) and foldable on the fourth portion (P4) about the second longitudinal score line (L2).

The cited aim is obtained with a cutting station according to claim 1.

The present invention also has the aim of providing a machine for obtaining the cardboard blank described in the foregoing, starting from a continuous strip of cardboard stored in a fanfold, and for carrying out all the operations necessary for carrying out the packaging of an article internally of a box obtained from the cardboard blank.

The objective of the invention is to provide a machine able to carry out all the operations necessary for completing the packaging of the article very rapidly and efficiently, with the aim of guaranteeing high productivity in terms of numbers of articles packaged per hour, up to even 1000 articles packaged per hour.

This aim is obtained by a machine for packing an article internally of a cardboard box obtained from a cardboard blank as described in the preamble, according to claim 14, and comprising the cutting station of claim 1.

BRIEF DESCRIPTION OF THE DRAWINGS

The characteristics of a preferred embodiment of a cutting station for making transversal cuts in a cardboard sheet starting from a continuous strip of cardboard, and a machine for packaging an article internally of a cardboard box obtained from the cardboard sheet, of the present invention, will be described in the following with reference to the appended tables of drawings, in which.

Figure 1:
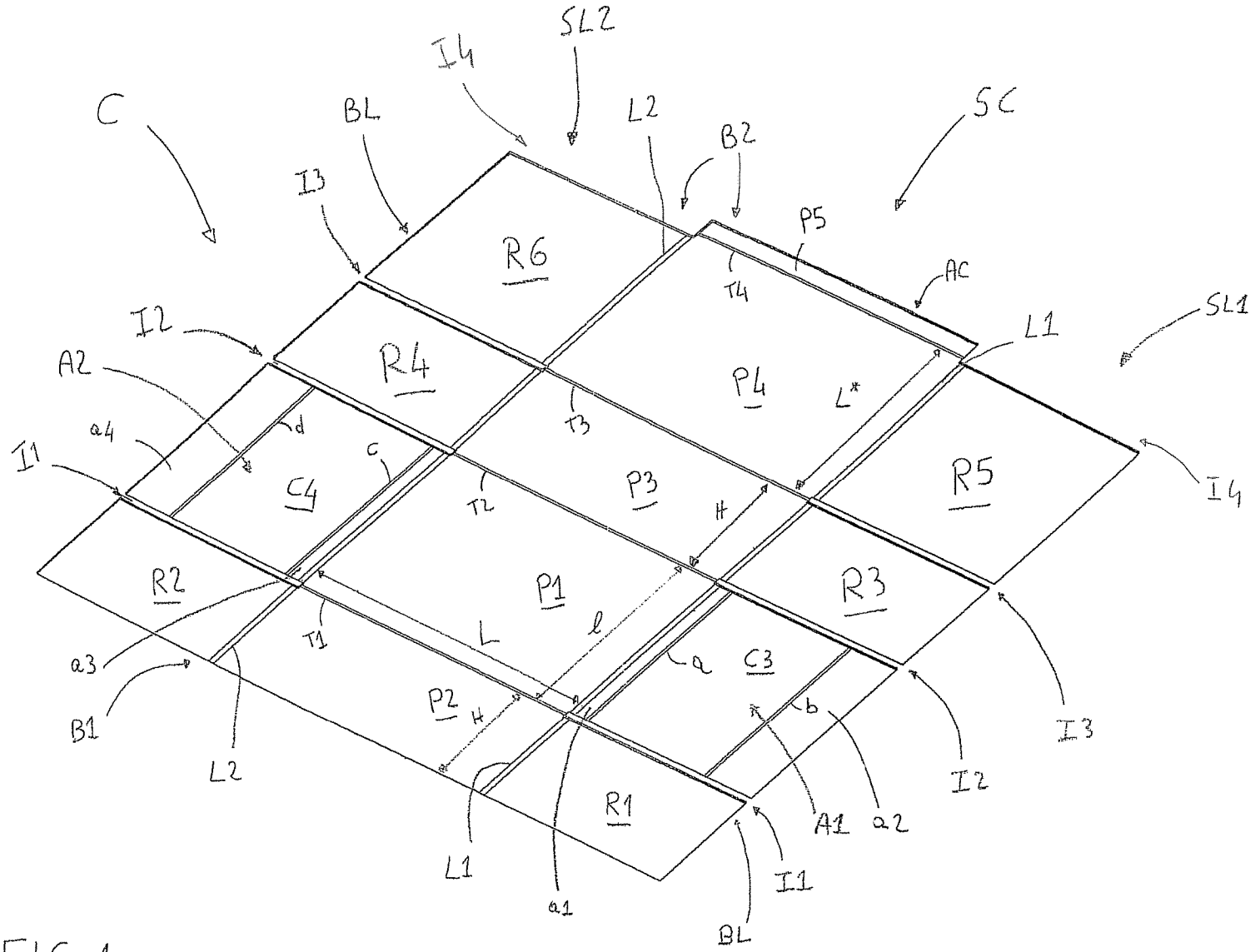
FIG. 1, mentioned in the preamble to the present description, in a perspective view, illustrates the cardboard packaging designed by the Applicant and object of the above-cited Italian patent application, which cardboard blank is produced in outlet from the cutting machine of the invention and which the machine of the invention, comprising the cutting station, is able to process in the successive work stations so as to pack an article in a cardboard box obtained from the cardboard blank.
Figure 2A:
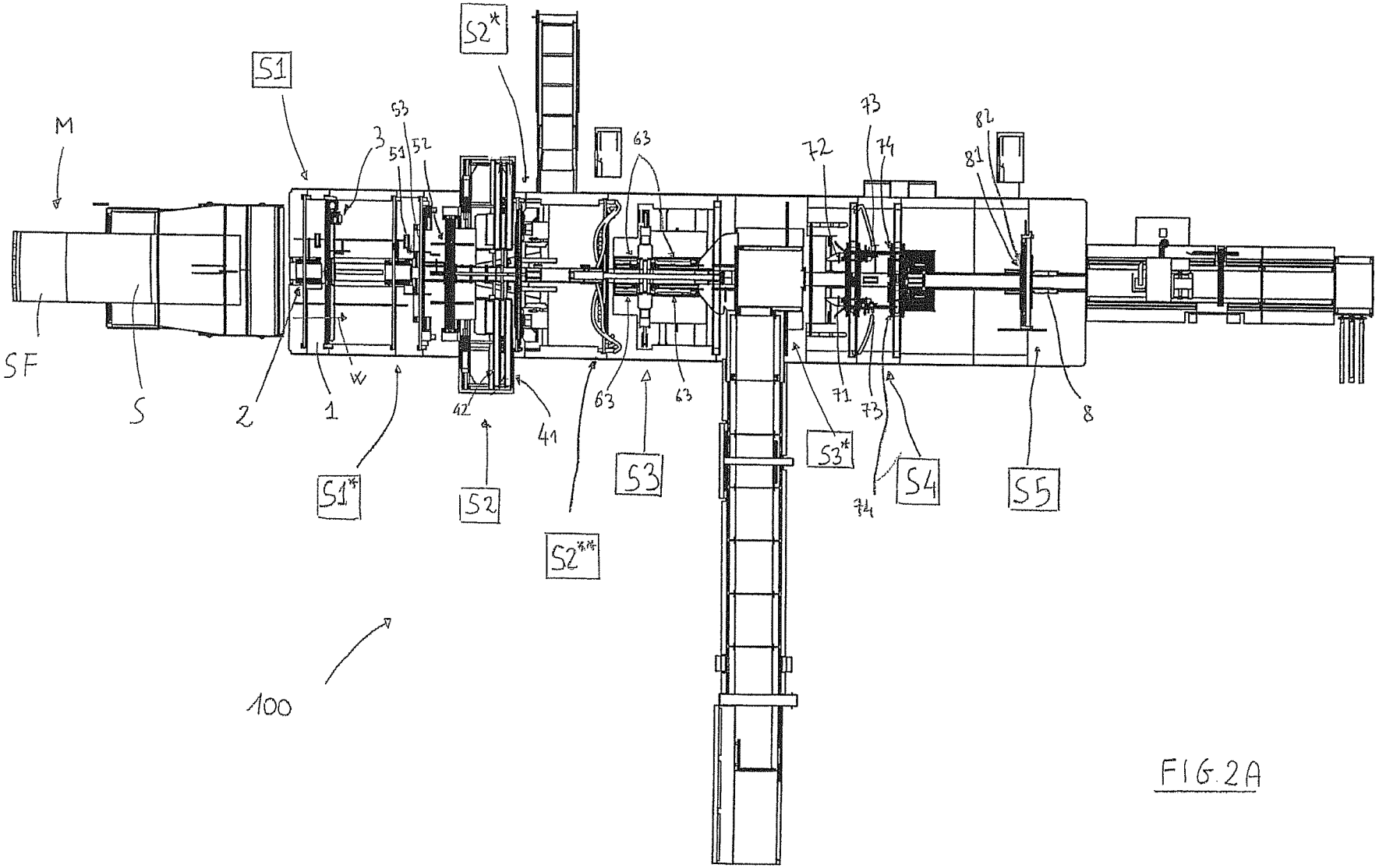
Figure 2B:
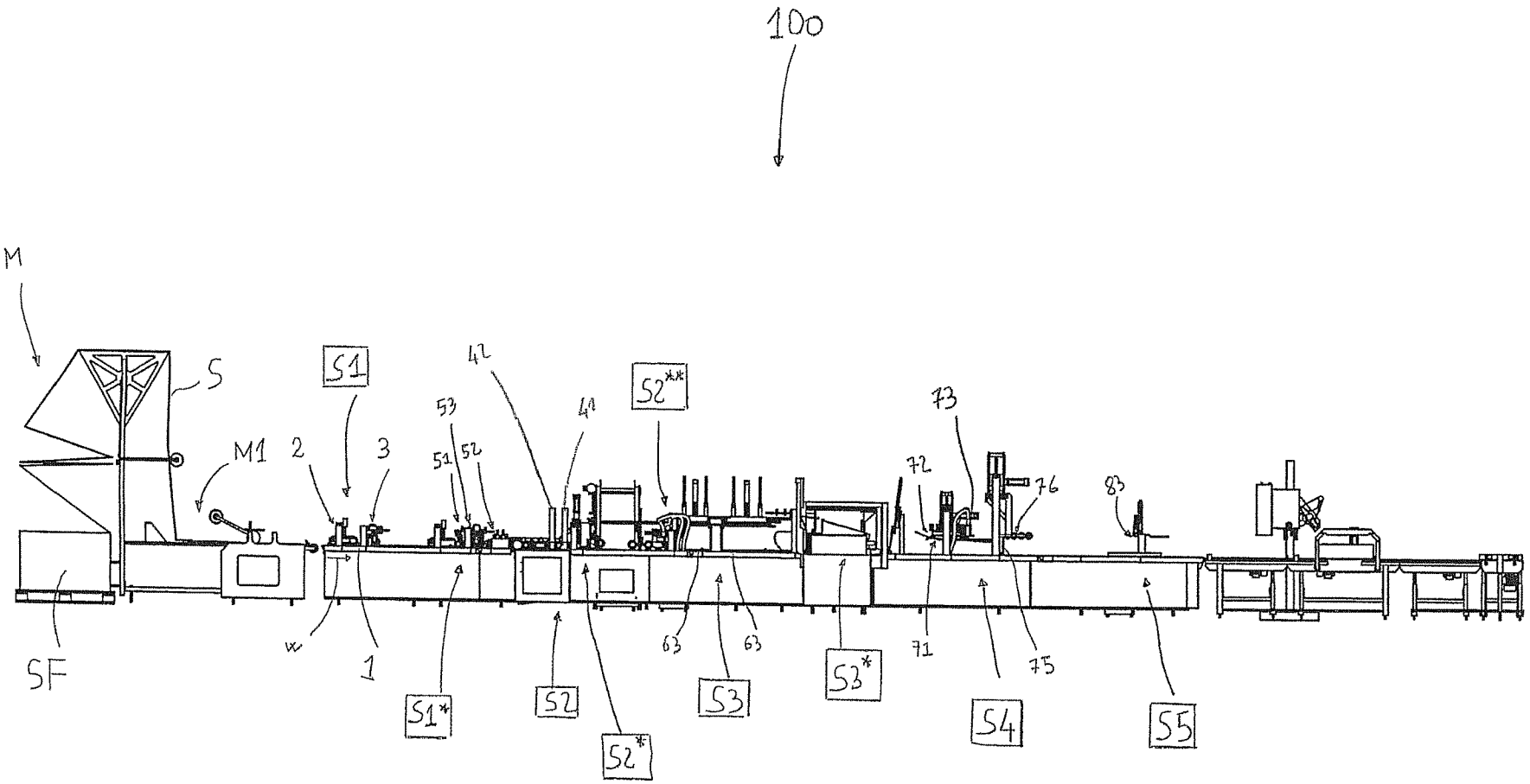
Figure 2C:
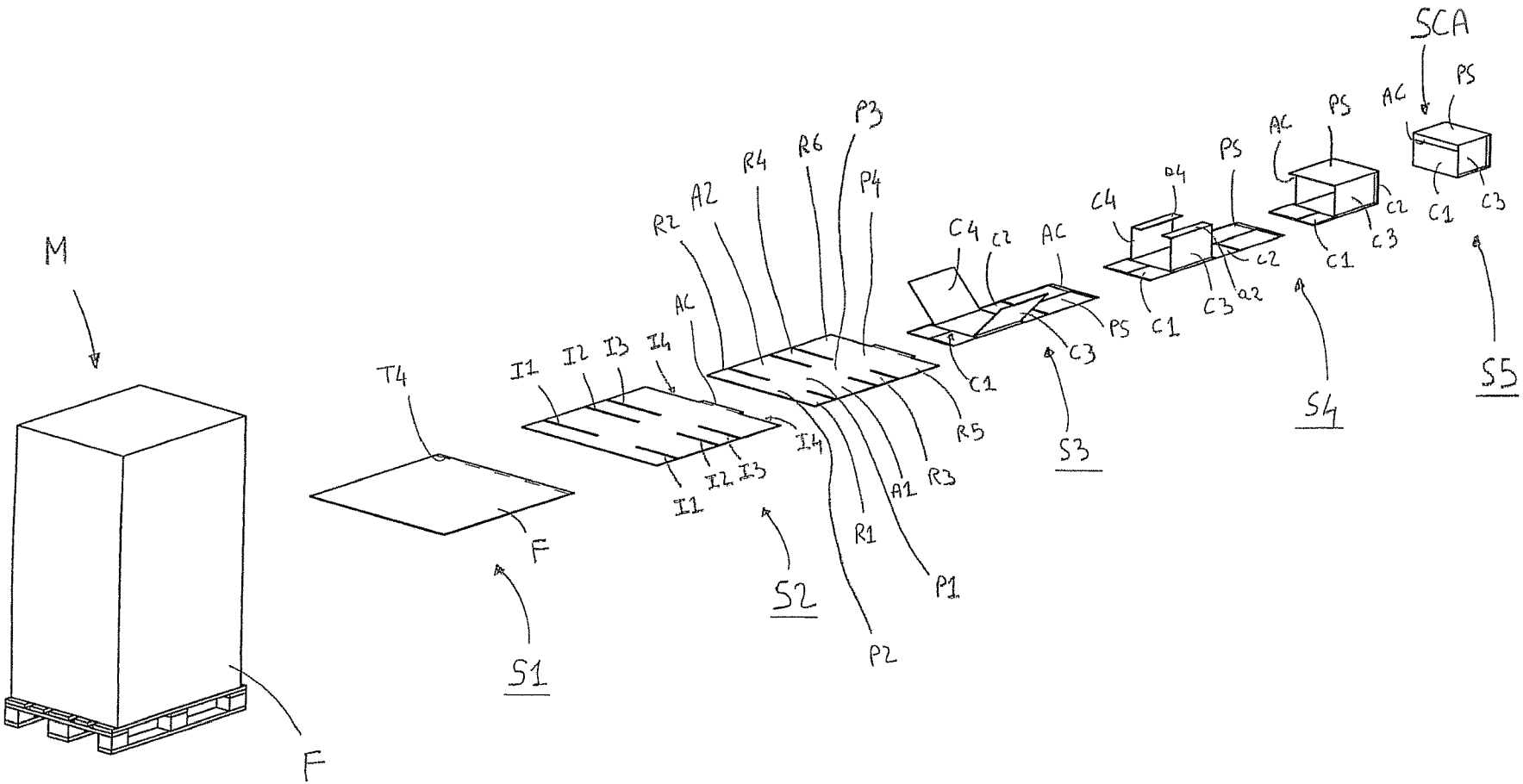
Figure 2D:
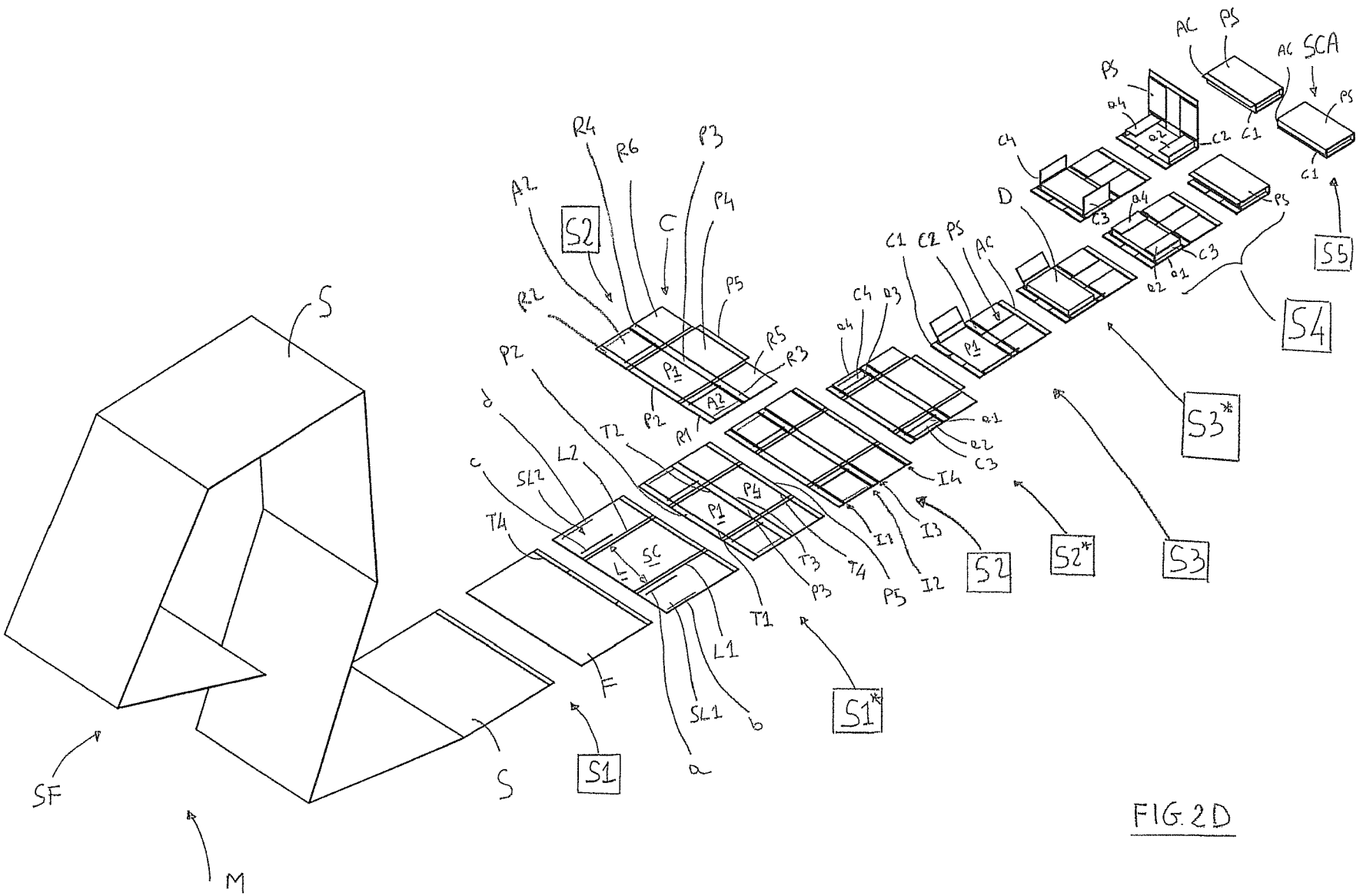
Figure 3A:
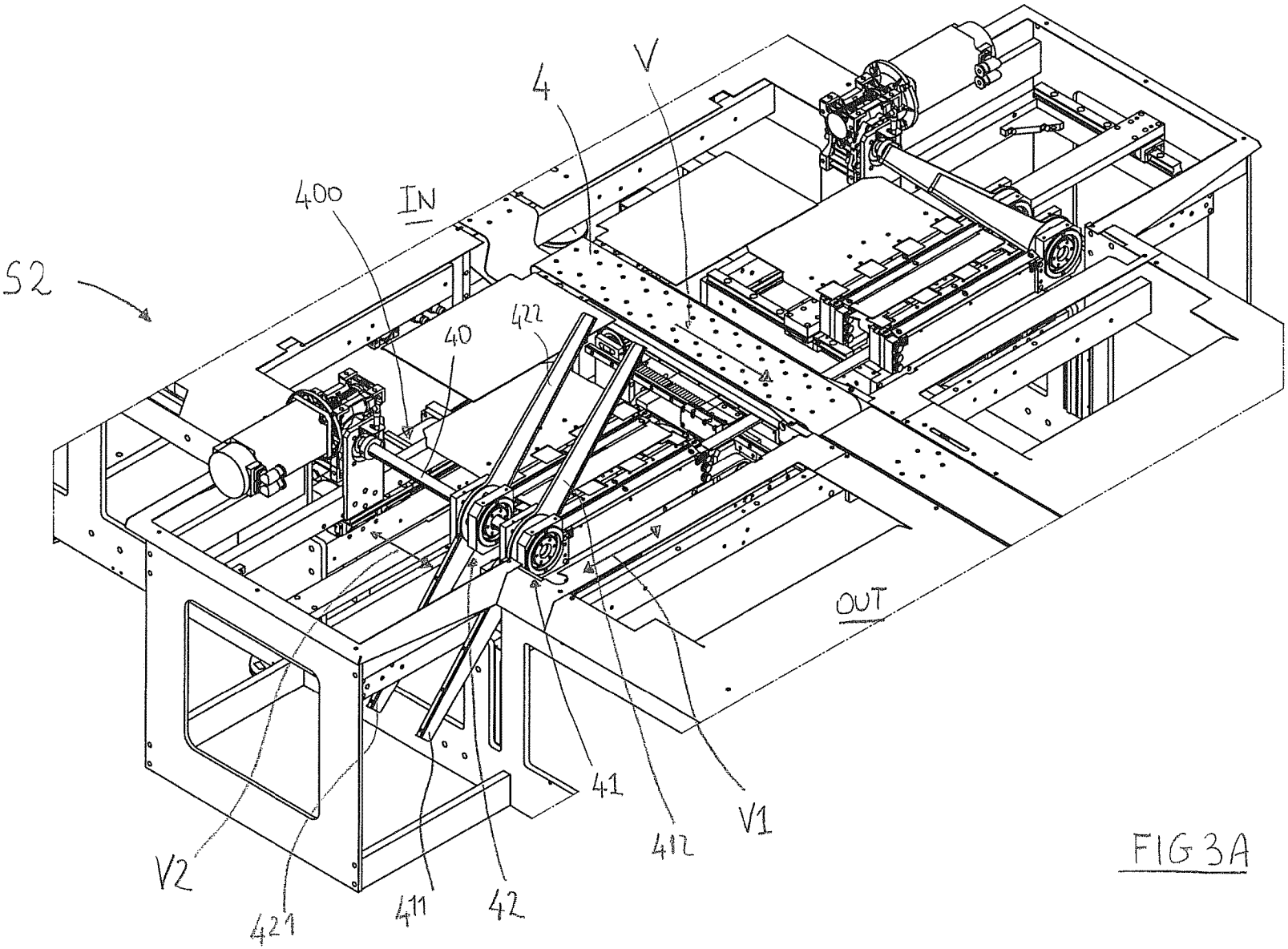
Figure 3B:
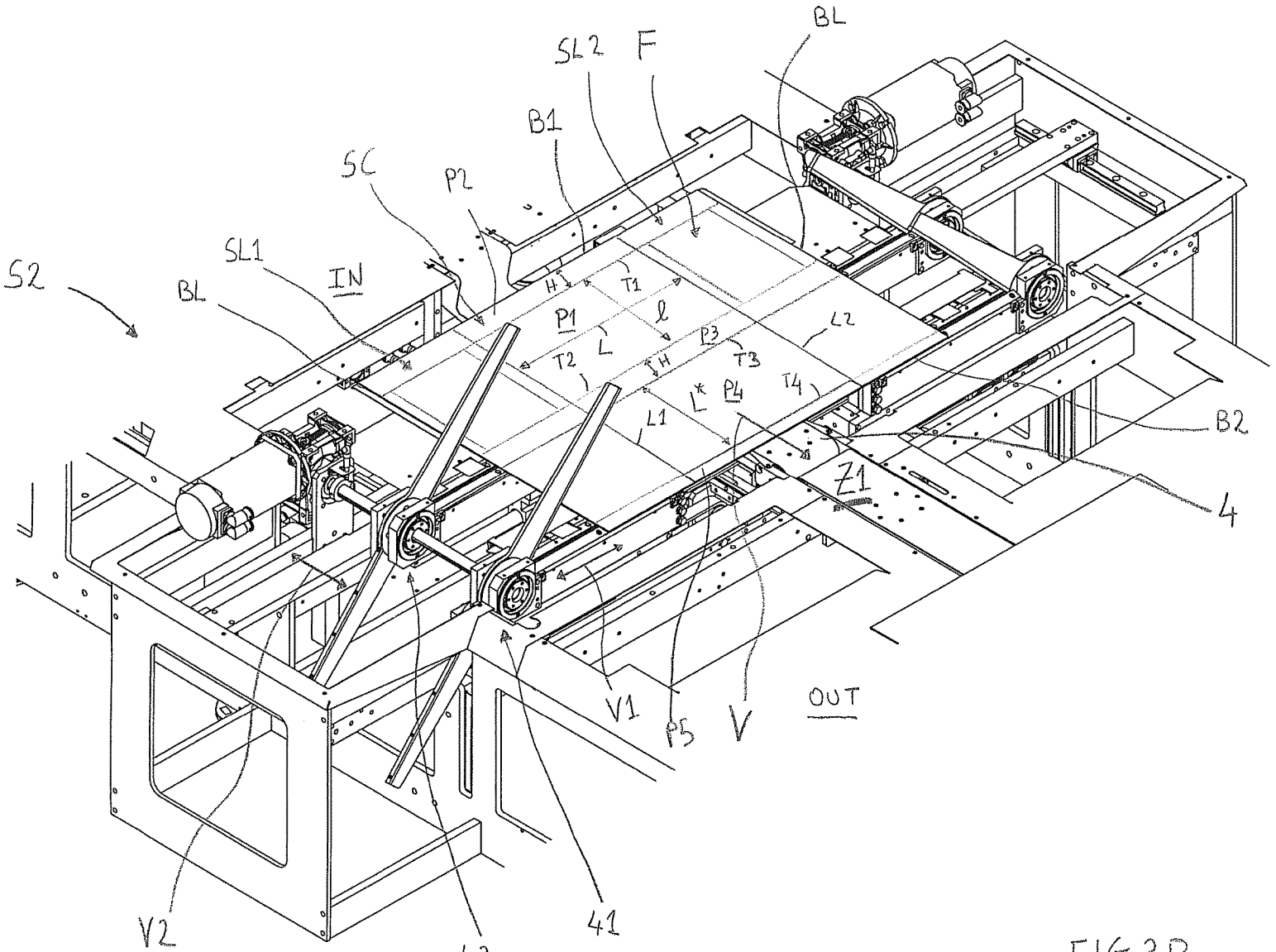
Figure 3C:
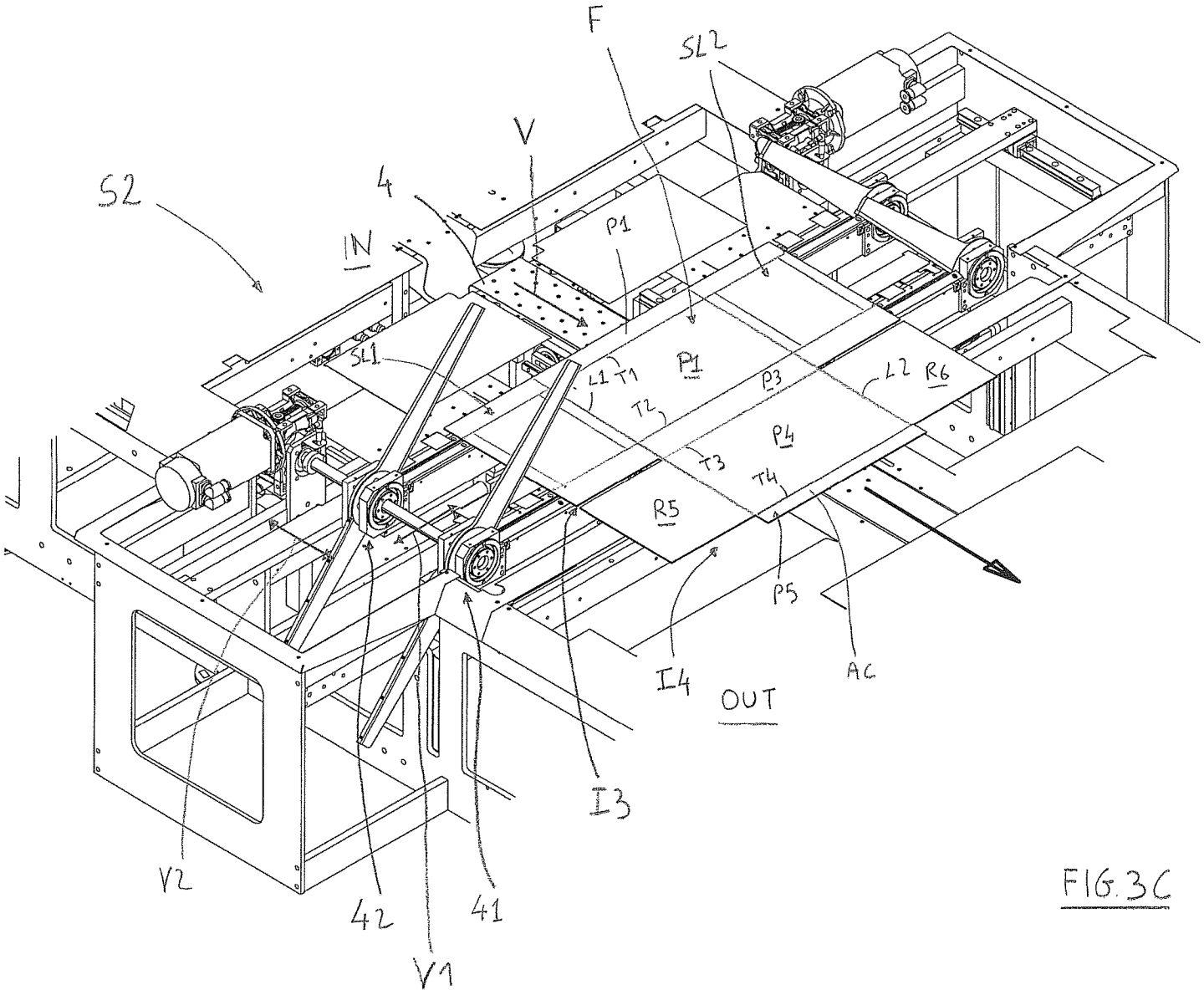
Figure 3D:
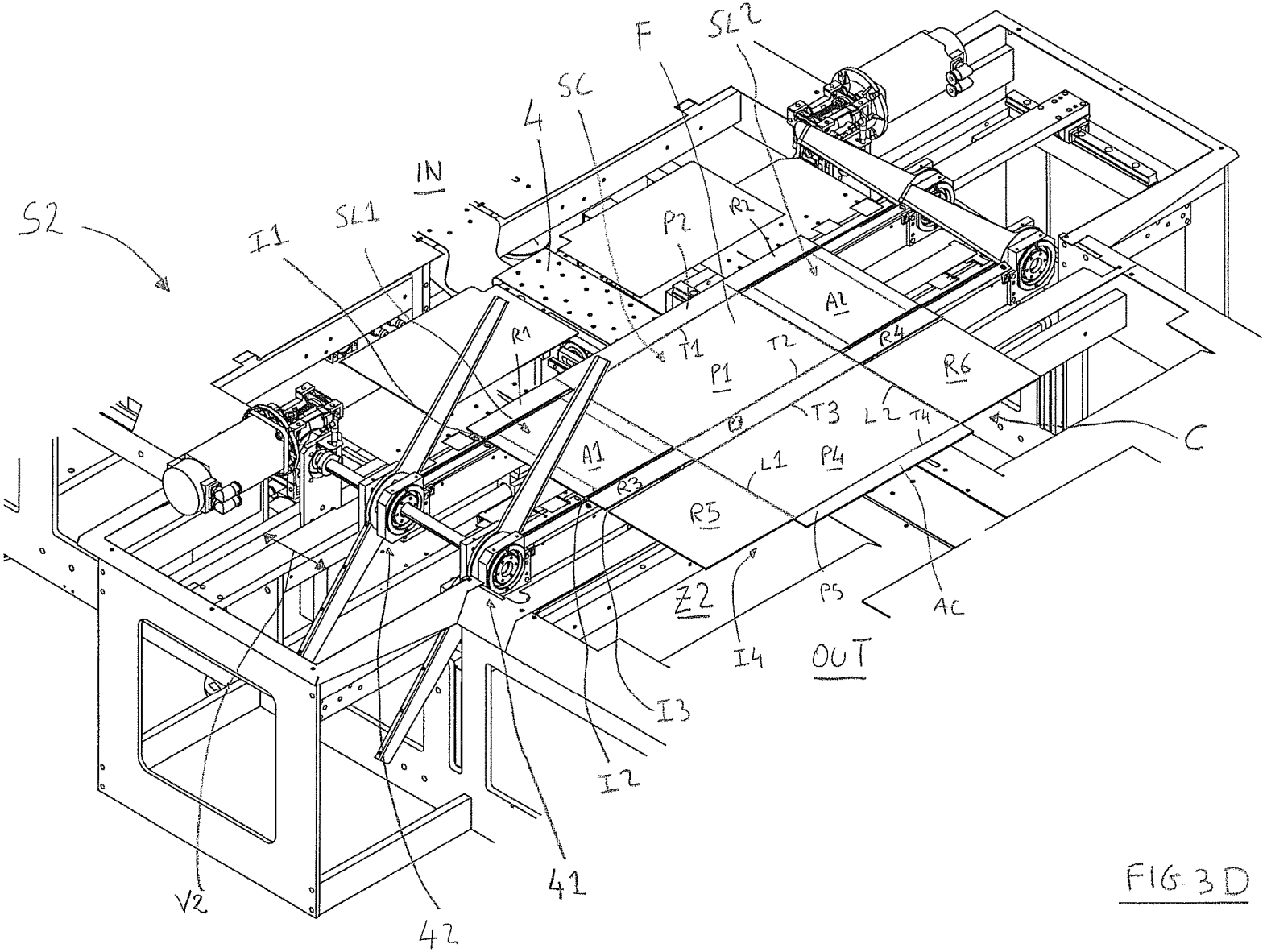
Figure 3E:
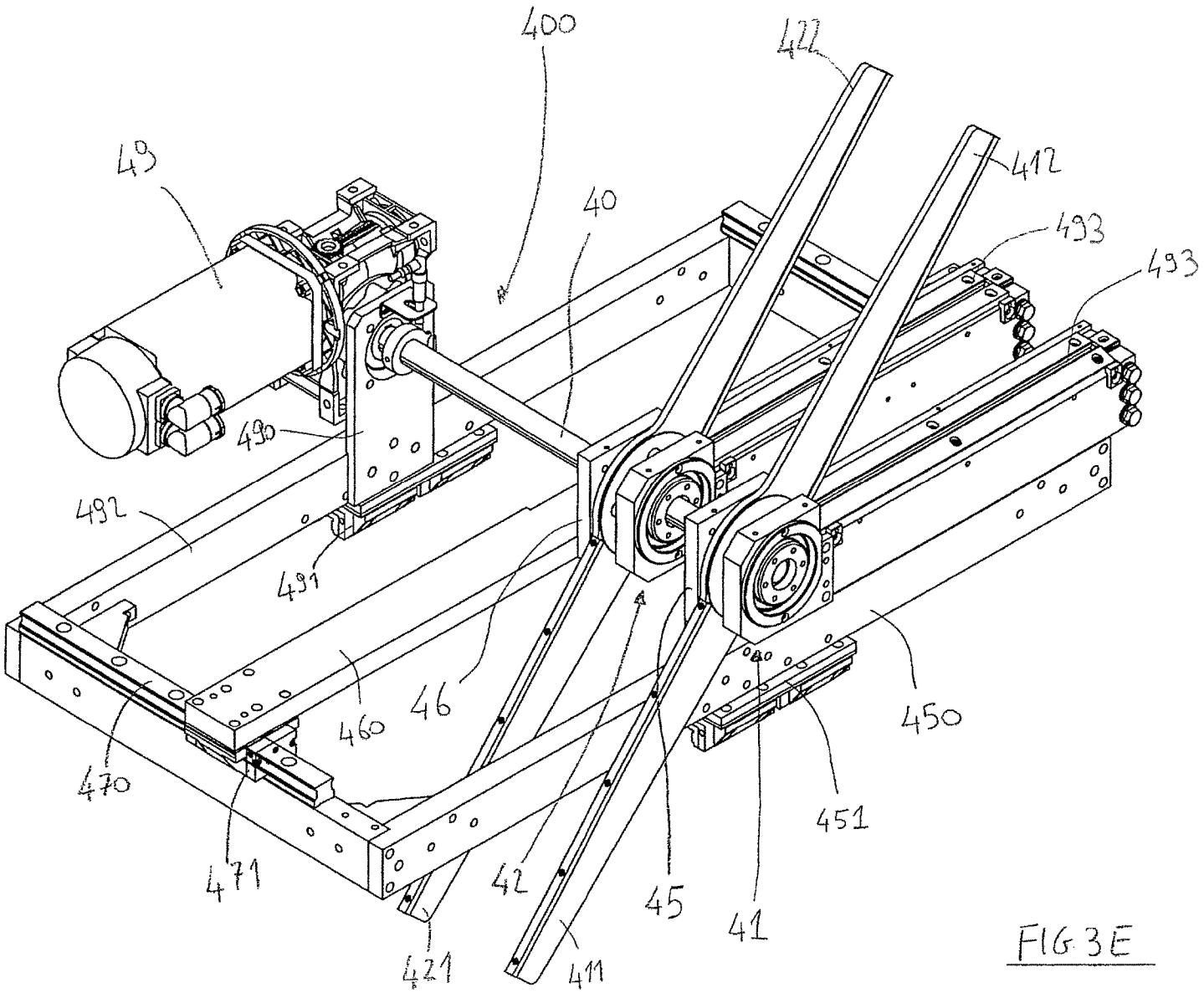
Figure 3F:
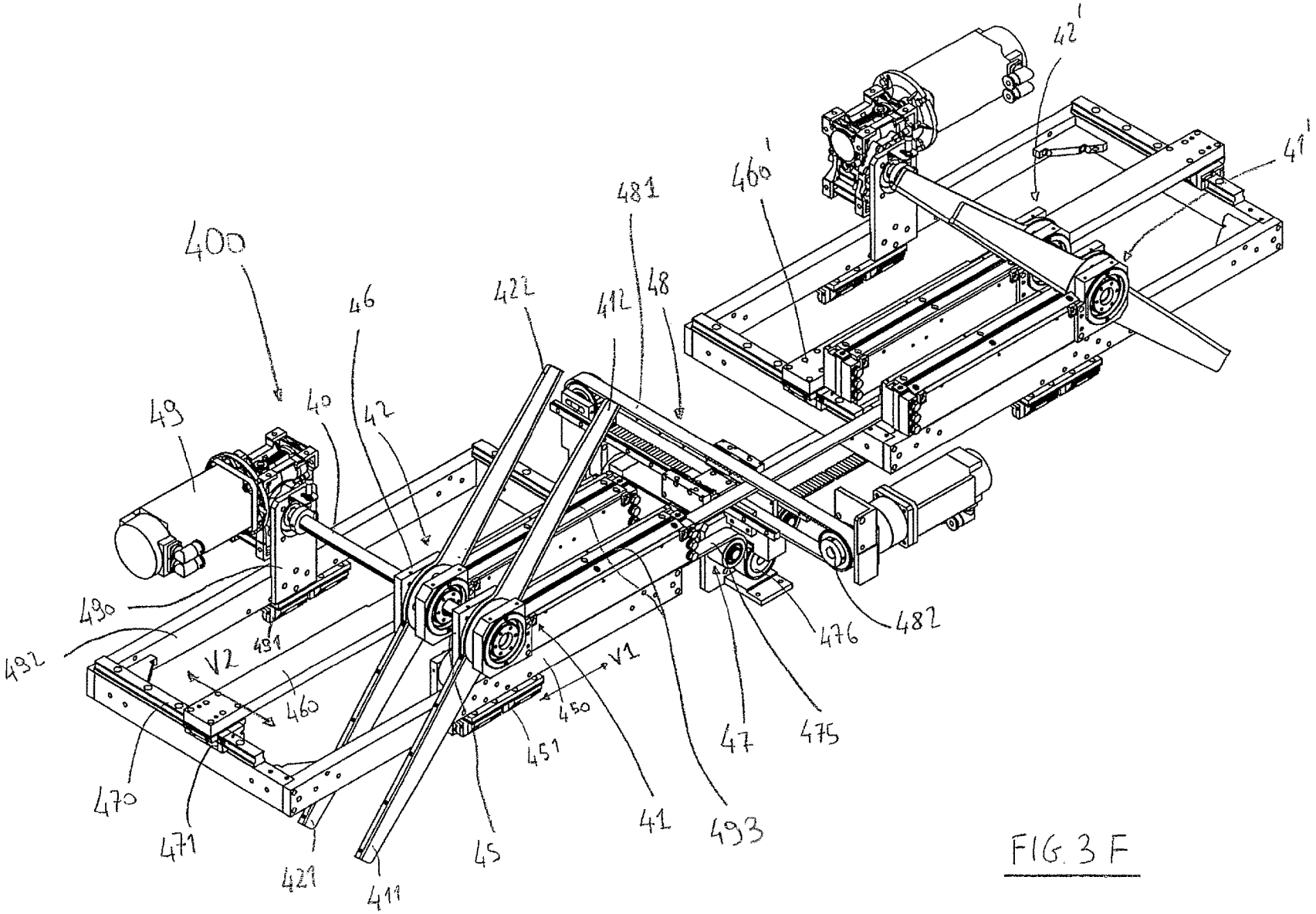
Figure 3G:
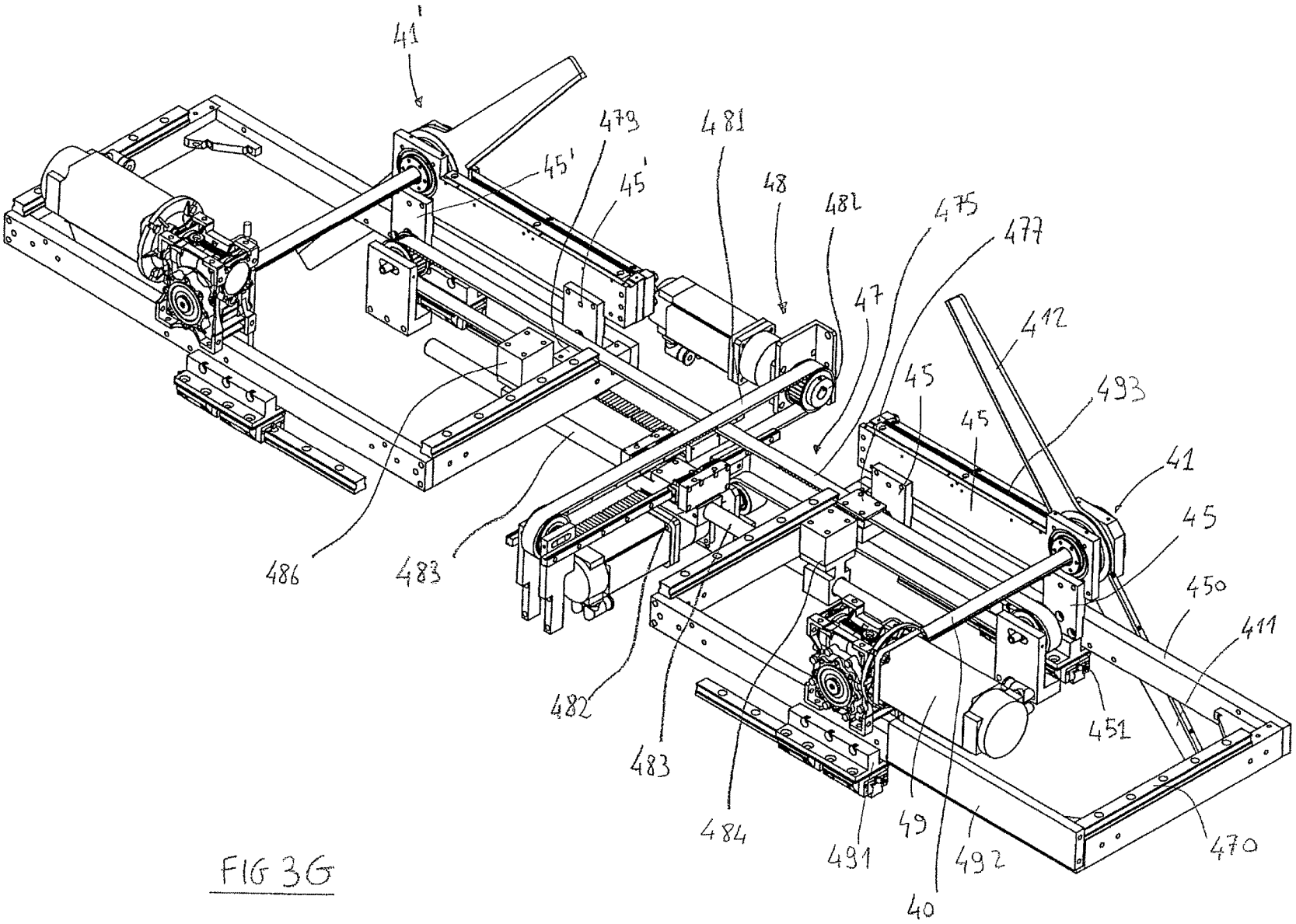
Figure 3H:
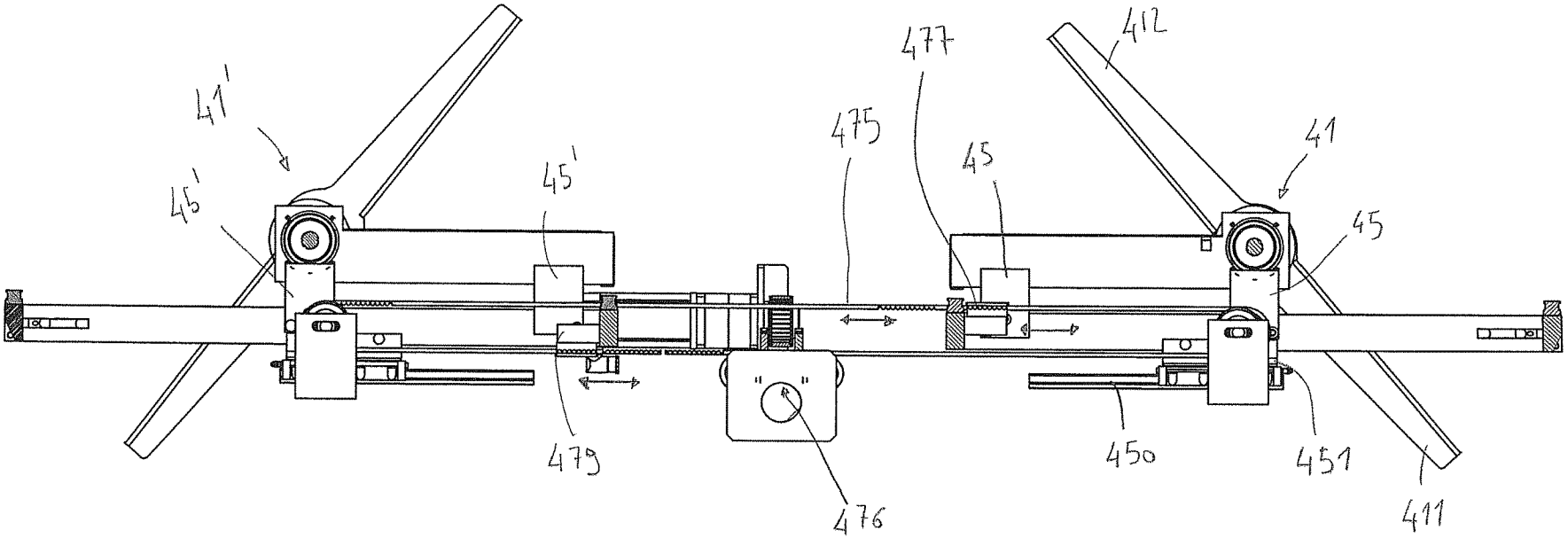

FIGS. from 1A to 1F illustrate, according to respective perspective views, possible folding steps of the cardboard blank of FIG. 1 so as to enable packaging an article and obtaining a closed cardboard box with the article inside;

FIG. 2A illustrates, in a schematic view from above of the layout of a machine for packing an article internally of a cardboard box obtained from a cardboard sheet of the present invention;

FIG. 2B illustrates the machine of FIG. 2 in a lateral view;

FIG. 2C schematically illustrates, in a succession of images, example embodiments of some main work operations that the packaging machine of the invention carries out starting from a cardboard sheet cut from a continuous strip of cardboard contained in a fanfold, for obtaining first the cardboard blank illustrated in FIG. 1, and then folding the cardboard blank about an article and obtaining a closed cardboard box with the article packaged and closed inside it;

FIG. 2D very schematically illustrates, with a succession of images in perspective view, the operating sequence of the machine of the present invention;

FIG. 3A illustrates, in a schematic perspective view, the cutting station of the present invention for realising the transversal cuts in the two lateral sectors (SL1, SL2) of a cardboard sheet;

FIGS. 3B, 3C, 3D illustrates, in a schematic perspective view, the working sequence of the cutting station for realising the four transversal cuts in each of the two lateral sectors (SL1, SL2) of a cardboard sheet which is provided in inlet to the cutting station of the invention;

FIG. 3E illustrates, in a schematic perspective view, some significant details of the cutting station of the present invention;

FIG. 3F illustrates, in a schematic perspective view, some significant components of the cutting station of the present invention;

FIG. 3G illustrates some components of FIG. 3F according to another perspective view from a different angle, with other components that have been removed in order to more clearly show other details;

FIG. 3H illustrates, in a front view, some of the main and significant components of the cutting station of the present invention.

DESCRIPTION OF THE PREFERRED EMBODIMENTS

With reference to the appended figures of the drawings, (S2) denotes the cutting station for realising transversal cuts in a cardboard sheet of the present invention, while reference numeral (100) denotes the machine for packaging an article internally of a cardboard box obtained from the cardboard sheet in its entirety, comprising the cutting station (S2).

The cutting station (S2) of the present invention is designed, as mentioned in the foregoing, to make transversal cuts in a cardboard sheet, in particular it is designed to make four transversal cuts at four transversal score lines present on the cardboard sheet (a cut at each transversal folding line).

In detail, the cutting station (S2) comprises a inlet (IN), for receiving a cardboard sheet (F), an outlet (OUT), for providing in outlet a cardboard blank with the transversal cuts, and a conveyor (4), for example conveyor belt, which extends from the inlet (IN) to the outlet (OUT) for conveying the cardboard sheet (F) from the inlet (IN) to the outlet (OUT) according to an advancement direction (V).

The cutting station (S2) is able to receive at the inlet (IN) thereof a cardboard sheet (F) which is fed to the inlet (THE) in an orientation such as to present the relative two transversal edges (B1, B2) arranged transversally and perpendicularly to the conveyor (4), and to the advancement direction (V) of the conveyor (4), and the relative longitudinal edges (BL) parallel to the conveyor (4), and therefore to the advancement direction (V) of the conveyor (4).

The cutting station (S2) receives at the inlet (IN) thereof a cardboard sheet (F) which comprises two longitudinal score lines (L1, L2), parallel to the longitudinal edges (BL) of the cardboard sheet (F) and to the advancement direction (V) of the conveyor (4) and four transversal score lines (T1, T2, T3, T4), parallel to the transversal edges (B1, B2) of the cardboard sheet (F), and transversal and perpendicular to the advancement direction (V) (see for example FIG. 3).

The two longitudinal score lines (L1; L2) are parallel to one another, from a first transversal edge (B1) to a second transversal edge (B2) of the cardboard sheet (F), and at a reciprocal distance from one another corresponding to the length (L) of the base of the article to be packed inside a cardboard box which is obtained from the cardboard sheet (F), The four transversal score lines (T1, T2, T3, T4)) are parallel to one another, from one longitudinal edge (BL) to the other longitudinal edge (BL) of the cardboard sheet (F), and are distanced from one another as a function of the effective dimensions of the article to be packed, in particular on the basis of the width of the base of the article, the width (L*) of the upper face of the article and the height (H) of the flanks of the article.

In particular, starting from a first transversal edge (B1) of the cardboard sheet (F), being the upstream edge relative to advancement direction (V) of the conveyor (4):

- a first transversal score line (T1) at a distance from the first transversal edge (B1) of the cardboard sheet (F) corresponding to the height (H) of a first lateral flank of the article,
- a second transversal score line (T2) is at a distance from the first score line (T1) corresponding to the width (I) of the base of the article to be packed;
- a third transversal score line (T3) at a distance from the second transversal score line (T2) corresponding to a height (H) of a second flank of the article, parallel and opposite the first flank;
- a fourth transversal score line (T4) at a distance from the third transversal score line (T3) corresponding to the width (L*) of the upper face of the article to be packed;

Therefore the cardboard sheet (F) that the cutting station (S2) receives at the inlet (IN) thereof will have a central sector (SC), between the two longitudinal score lines (L1, L2), and two lateral sectors (SL1, SL2) externally of the two longitudinal score lines (L1, L2) and, in the central sector (SC), the cardboard sheet (F) comprises five portions (P1, P2; P3, P4, P5) defined by the four transversal score lines (T1, T2; T3, T4), in particular (see FIG. 3B once more):

- a first portion (P1), between the first transversal score line (T1) and the second transversal score line (T2);
- a second portion (P2), between a first transversal edge (B1) of the cardboard sheet (F) and the first transversal score line (T1), adjacent to the first portion (P1) and hinged thereto by means of the first transversal score line (T1);
- a third portion (P3), between the second transversal score line (T2) and the third transversal score line (T3), adjacent to the first portion (P1) and hinged thereto by means of the second transversal score line (T2);
- a fourth portion (P4), between the third transversal score line (T3) and the fourth transversal score line (T4), adjacent to the third portion (P3) and hinged thereto by means of the third transversal score line (T3);
- and a fifth portion (P5) between the fourth transversal score line (T4) and the second transversal edge (B2) of the cardboard sheet (F).

The conveyor (4) is predisposed so that the cardboard sheet (F) is arranged thereon resting with at least a part of the central sector (SC) thereof and with the two lateral sectors (SL1, SL2) which project laterally beyond the two sides of the conveyor (4).

The cutting station (S2) of the present invention comprises, by the flank of each of the two sides of the conveyor (4), a first cutting group (41) and a second cutting group (42), which are predisposed for realising transversal cuts on a relative lateral sector of the two lateral sectors (SL1, SL2) of the cardboard sheet (F), the first cutting group (41) being arranged downstream of the second cutting group (42) with respect to the advancement direction (V) of the conveyor (4).

Therefore, in practice, the cutting station (S2) of the invention comprises four cutting groups, two for each side of the conveyor. In the following only the two cutting groups situated on a same side of the conveyor are described, as the structure and functioning of the other two cutting groups on the other side of the conveyor are the same.

The first cutting group (41) and the second cutting group (42) are predisposed by a flank of a side of the conveyor (4) so as to be able to be translated, contemporaneously, alternatingly in a perpendicular and transversal direction (V1) to the conveyor (4), and therefore so as both to be able to be neared to or distanced from the conveyor (4), so that they can be positioned and halted at and above a respective lateral sector (SL1, SL2) of the cardboard sheet (F), which is arranged on the conveyor (4) so as to be able to realise transversal cuts thereon.

This enables, on the basis of the effective dimensions of the cardboard sheet (F), i.e. on the basis of the effective dimensions (width) of the two lateral sectors (SL1, SL2) to effectively position the two cutting groups at and above the relative lateral sector of the cardboard sheet in which the transversal cuts are to be made.

Further, the second cutting group (42) (the group upstream of the first cutting group (41) with respect to the advancement direction (V) of the conveyor (4)) is predisposed so as to be able to be translated with respect to the first cutting group (41), alternatingly in a parallel direction (V2) to the conveyor (4), in such a way that the second cutting group (42) can be neared to or distanced from the first cutting group (41).

This detail enables the cutting station (S2) to adjust to the effective reciprocal position and distance of the transversal score lines (T1, T2, T3; T4) present in the cardboard sheet (F), i.e. the effective reciprocal position and distance of the fourth transversal score lines (T1, T2, T3, T4) on the two lateral sectors (SL1, SL2) of the cardboard sheet (F) at which the corresponding four transversal cuts (I1, I2, I3, I4) are to be made.

The functioning of the cutting station (S2) of the present invention is as follows.

The conveyor (4), once having received the cardboard sheet (F) at the inlet (IN) of the station (S2) with the first transversal score line (T1) arranged upstream and the fourth transversal score line (T4) arranged downstream with respect to the advancement direction (V) of the conveyor (4), is able to advance the cardboard sheet (F) according to the advancement direction (V) up to halting it in a first position (Z1) at which the fourth transversal score line (T4) is situated below the first cutting group (41) (see FIG. 3B).

In consideration and on the basis of the effective dimensions of the two lateral sectors (SL1, SL2), in particular the effective width thereof, the two cutting groups (41, 42) can be translated perpendicularly to the conveyor (4) along the direction (V1) so as to near them to, or distance them from, the conveyor (4) and thus be halted and positioned in a position above and at the relative lateral sector (SL1, SL2) on which the cuts are to be performed.

Further, on the basis of the effective dimensions of the cardboard sheet (F) and the effective positions of the transversal score lines (T1, T2, T3, T3), in a case where the second cutting group (42) is not above the third transversal score line (T3), the second cutting group (42) is translated with respect to the first cutting group (41) along the direction (V2) parallel to the advancement direction (V) of the conveyor (4), nearing it to, or distancing it from, the first cutting group (41), so as to position it above the effective position of the third transversal score line (T3) present in the cardboard sheet (F).

Once these adjustments have been carried out, if necessary, the two cutting groups (41, 42) are thus activated for realising corresponding cuts in the relative lateral sector (SL1, SL2) of the cardboard sheet (F), in particular: the first cutting group (41) realises a cut (I4) in the relative lateral sector (SL1, SL2) at the fourth transversal score line (T4) on the longitudinal edge (BL) of the cardboard sheet (F) up to the respective longitudinal score line (L1, L2) delimiting the central sector (SC), while the second cutting group (42) realises a cut (I3) in the relative lateral sector (SL1, SL2) at the third transversal score line (T3) on the longitudinal edge (BL) of the cardboard sheet (F) up to the respective longitudinal score line (L1, L2) delimiting the central sector (SC) (see FIG. 3C).

Once these two cuts have been made, the conveyor (4) is activated to advance the cardboard sheet (F) in the advancement direction (V) up to halting it in a second position (Z2) (see FIG. 3D) at which the second transversal score line (T2) is positioned below the first cutting group (41).

In a case where the second cutting group (42) is not above the first transversal score line (T1), the second cutting group (42) is translated relative to the first cutting group (41) along the direction (V2) parallel to the advancement direction (V) of the conveyor (4), nearing it to, or distancing it from, the first cutting group (41), so as to position it above the effective position of the first transversal score line (T1) present in the cardboard sheet (F).

Once this adjustment has been carried out, if necessary, the two cutting groups (41, 42) are then activated for realising corresponding cuts in the relative lateral sector (SL1, SL2) of the cardboard sheet (F), in particular: the first cutting group (41) realises a cut (I2) in the relative lateral sector (SL1, SL2) at the second transversal score line (T2) on the longitudinal edge (BL) of the cardboard sheet (F) up to the respective longitudinal score line (L1, L2) delimiting the central sector (SC), while the second cutting group (42) realises a cut (I1) in the relative lateral sector (SL1, SL2) at the first transversal score line (T1) on the longitudinal edge (BL) of the cardboard sheet (F) up to the respective longitudinal score line (L1, L2) delimiting the central sector (SC).

In this way, in each of the two lateral sectors (SL1, SL2) of the cardboard sheet (F), four transversal cuts (I1, I2, I3, I4) are made at the four transversal score lines (T1, T2, T3, T4) (see FIG. 3D) (i.e. a cut at each transversal score line).

Figure 1A:
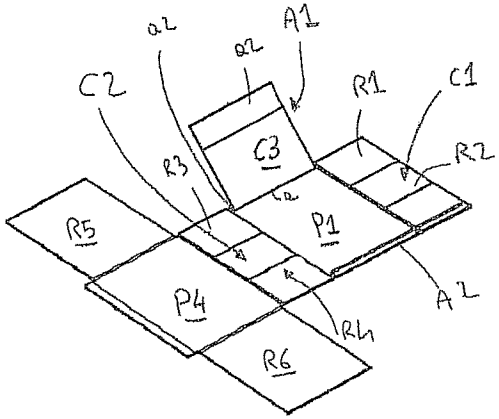
Figure 1B:
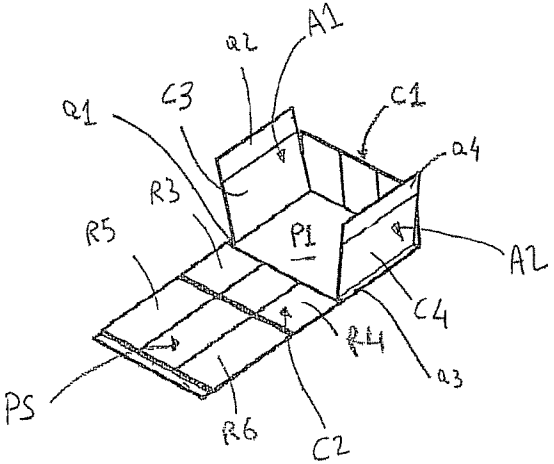
Figure 1C:
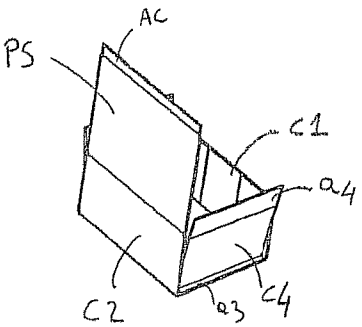
Figure 1D:
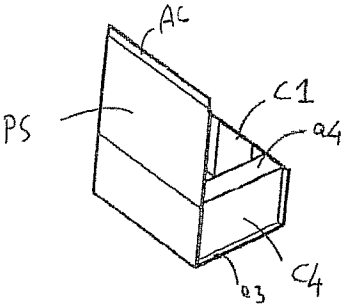
Figure 1E:
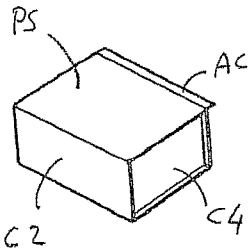
Figure 1F:
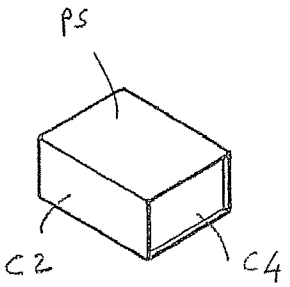

The cutting station (S2) of the invention thus provides, at the outlet (OUT) thereof (FIG. 3D), a cardboard blank C) exactly like the one described in the preamble and illustrated in FIG. 1, utilisable for packing and packaging an article internally of a cardboard box obtained by the cardboard blank, i.e. a cardboard blank which comprises, in the two lateral sectors (SL1, SL2) thereof:

between the first transversal edge (B1) of the cardboard blank (C) and the transversal cuts (I1) made at the first transversal score line (T1): a first reinforcing flap (R1), at a first end of the second portion (P2), foldable on the second portion (P2) about the first longitudinal score line (L1), —and a second reinforcing flap (R2) at a second end of the second portion (P2) and foldable on the second portion (P2) about the second longitudinal score line (L2) so as to at least partly superpose on the first reinforcing flap (R1): the second portion (P2) with the first (R1) and second reinforcing flap (R2) folded thereon and at least partly superposed, constitutes a first lateral closing wall (C1) which is foldable about the first transversal score line (T1) for covering the first lateral flank of the article to be packed (see for example FIGS. 1A, 1B, or the sequence of images of FIGS. 2C, 2D);

between the transversal cuts (I2) made at the second transversal score line (T2) and the transversal cuts (I3) made at the third transversal score line (T3): a third reinforcing flap (R3) at a first end of the third portion (P3), foldable on the third portion (P3) about the first longitudinal score line (L1), and a fourth reinforcing flap (R4) at a second end of the third portion (P3) and foldable on the third portion (P3) about the second longitudinal score line (L2) so as to at least partly superpose on the third reinforcing flap (R3): the third portion (P3) with the third (R3) and fourth (R4) reinforcing flap folded thereon and at least partly superposed, constitutes a second lateral closing wall (C2) which foldable about the second transversal score line (T2) for covering the second lateral flank, opposite the first flank, of the article to be packed (see for example FIGS. 1B, 1C or the sequence of images of FIGS. 2C, 2D);

between the first transversal cuts (I1) made at the first transversal score line (T1) and the transversal cuts (I2) made at the second transversal score line (T2), a first lateral enveloping flap (A1) at a first end of the first portion (P1), foldable about the first longitudinal score line (L1) for covering and enveloping a third lateral flank of the article to be packed, and a second lateral enveloping flap (A2), at a second end of the first portion (P1), foldable about the second longitudinal score line (L2) for covering and enveloping the fourth flank, opposite the third flank, of the article to be packed (see FIGS. 1A, 1B or the sequence of images of FIGS. 2C, 2D);

between the transversal cuts (I3) made at the third transversal score line (T3) and the transversal cuts (I4) made at the fourth transversal score line (T4), a fifth reinforcing flap (R5) at a first end of the fourth portion (P4), foldable on the fourth portion (P4) about the first longitudinal score line (L1), and a sixth reinforcing flap (R6) at a second end of the fourth portion (P4) and foldable on the fourth portion (P4) about the second longitudinal score line (L2) so as to at least partly superpose on the fifth reinforcing flap (R5): the fourth portion (P4) with the fifth (R5) and sixth (R6) reinforcing flap folded thereon and at least partly superposed, constitutes an upper closing wall (PS) which is foldable about the third transversal score line (T3), once the second lateral closing wall (C2) has been folded about the second transversal score line (T2) for covering the second lateral flank, for covering the upper face of the article to be packed (see FIGS. 1A, 1F, or the sequence of images of FIGS. 2C, 2D);

between the fourth transversal score line (T4) and the second transversal edge (B2), a tab (AC) which will constitute a tab for closing/opening the cardboard box.

Other advantageous and preferred characteristics of the cutting station (S2) proposed by the present invention are described in the following.

The cutting station (S2) comprises activating means (400) of the first cutting group (41) and the second cutting group (42) comprising a shaft (40) that is arranged parallel to the conveyor (4) and is activatable in rotation, the first cutting group (41) comprising a pair of cutting blades (411, 412) which are mounted on the shaft (40) in such a way as to be at 180° to one another and arranged perpendicular and transversal to the conveyor (4), the second cutting group (42) in turn comprising a pair of cutting blades (421, 422) which are also mounted on the shaft (40) at 180° to one another and arranged perpendicular and transversal to the conveyor (4) (see FIG. 3E).

The pair of blades (411, 412) of the first cutting group (41) and the pair of blade (421, 422) of the second cutting group (42) are mounted on the common shaft (40) so as to have a same angular orientation so that when the shaft (40) is activated in rotation to activate the blades of the two cutting groups for realising the transversal cuts in the lateral sectors of the cardboard sheet, the blades of the pair of blades of the two cutting groups contemporaneously reach and the lateral sectors of the cardboard sheet.

The pair of blades of the first cutting group and the pair of blades of the second cutting group arranged as specified in the foregoing, have an overall helix-like shape.

Owing to this special arrangement, the cutting station (S2) very rapidly carries out the cuts in the lateral sectors of the cardboard sheet, as at each 180° rotation of the shaft (40) two transversal cuts at a time are realised.

Therefore, to complete the realisation of the four cuts in each of the two lateral sectors of the cardboard sheet, two at a time as described in the foregoing, it is sufficient to perform a single complete rotation of the shaft (40).

The first cutting group (41) is borne by the first frame (45) while the second cutting group (42) is borne by the second frame (46); the cutting station (S2) comprises a first sliding guide (450) which is arranged so as to be transversal and perpendicular to the conveyor (4), and a second sliding guide (460) which is arranged parallel to the first sliding guide (450), and therefore transversal and perpendicular to the conveyor (4).

The first frame (45) is slidably mounted on the first sliding guide (450), for example the first frame (45) is mounted on a first carriage (451) which is coupled slidably to the first sliding guide (450) while the second frame (46) is slidably mounted on a second sliding guide (460) for example the second frame (46) is mounted on a second carriage (not visible in detail in the figures) slidably coupled to the second sliding guide (460).

The cutting station (S2) further comprises first movement means (47) which are configured and predisposed so as to alternatively translate the first frame (45), with respect to the first sliding guide (450), by means of the sliding of the carriage (451) along the first sliding guide (450), and thus to alternatingly translate the first cutting group (41) with respect to the first sliding guide (450) in such a way as to near them or distance them to/from the conveyor (4), in order to adjust the position of the first cutting group (41) to the actual position and dimension of the lateral sectors of the cardboard sheet borne by the conveyor (4).

As the first cutting group (41) and the second cutting group (42) are mounted on a same common shaft (40), the translation imparted on the first cutting group (41) by the first movement means (47) also determines the translation of the second cutting group (42) by means of the sliding of the second frame (46) with respect to the second sliding guide (460), by means of the sliding of the second carriage along the second sliding guide (460).

The cutting station (S2) further comprises a third sliding guide (470) which is, instead, arranged parallel to the conveyor (4) and therefore transversal and perpendicular to the first sliding guide (450) and to the second sliding guide (460).

The second sliding guide (460), with respect to which the second cutting group (42) can be made to slide so as to near or distance it to or from the conveyor (4), is coupled to the third sliding guide (470) and predisposed so as to be able to slide, and therefore be made to translate, with respect to the third sliding guide (470) so as to enable the second cutting group (42) to be translated with respect to the first cutting group (41), nearing or distancing it to/from the first cutting group (41), so as to adjust the position and distance between two adjacent transversal score lines present in the lateral sector of the cardboard sheet.

In this regard, the cutting station (S2) comprises second movement means (48) which are predisposed to move and slide the second sliding guide (460) with respect to the third sliding guide (470).

For example, a third carriage (471) which is predisposed at an extreme part of the second sliding guide (460) and is slidably coupled to the third sliding guide (470).

The activating means (400) of the two cutting groups (41, 42) further comprise a motor (49) for activating the shaft (40) in rotation, on which shaft (40) the two pairs of blades (411, 412) (421, 422) of each of the two cutting groups (41, 42) are mounted, the motor (49) being mounted on a relative frame (490) which is borne by a fourth carriage (491) mounted slidably on a fourth sliding guide (492) which is predisposed so as to be parallel to the first sliding guide (450) and to the second sliding guide (460), therefore transversal and perpendicular to the conveyor (4).

In this way, when the first movement means (47) move the first frame (45) with respect to the first sliding guide (450), for nearing or distancing the first cutting group (41) and the second cutting group (42) to the conveyor (4), the motor (49), responsible for the activating of the two cutting groups (41, 42), is also at the same time and in the same way neared to or distanced from the conveyor (4), following the sliding of the frame (490) on which it is mounted along the fourth sliding guide (492), by means of the sliding of the fourth carriage (491) along the fourth sliding guide (492).

The first movement means (47) comprise a belt (475) which is loop-wound on relative pulleys, of which at least a drive pulley (476) (visible in FIG. 3F) for activating the belt (475): in particular the pulleys are arranged so that the belt (475) is arranged transversal and perpendicular to the conveyor (4). i.e. to advancement direction (V) of the conveyor (4).

The first frame (45), bearing the first cutting group (41), is constrained by means of a clamp (477) to a branch of the belt (475), for example the upper branch of the belt (475).

In this way, when the drive pulley (476) is activated in rotation, in one rotation direction or another, the upper branch of the belt (475) is moved perpendicularly to the conveyor (4), in a direction towards the conveyor (4) or in a direction away from the conveyor (4): therefore the first frame (45), and then the first cutting group (41), like the second frame (46) and the second cutting group (42), can be neared to or distanced from the conveyor (4), along the above-cited direction (V1) so as to adjust the position thereof to the width of the lateral sector (SL1, SL2) of the cardboard sheet (F).

The cutting station (S2) advantageously comprises a single belt (475) which extends transversally below the conveyor (4) so that the frame (45'), which bears the corresponding first cutting group (41') located on the other side of the conveyor (4), can also be constrained, by means of a relative clamp (479); to a branch of the belt (475), in particular to the lower branch of the belt (475). In this way, with the activating of a single belt (475) it is possible to near or distance, at the same time, the cutting groups located on both sides of the conveyor, to or from the cardboard sheet located on the conveyor (see for example FIGS. 3G and 3H).

The second movement means (48) in turn comprise a belt (481) which is loop-wound on relative pulleys, of which at least a drive pulley (482): the pulleys are arranged so that the belt (481) is arranged below the conveyor (4) and parallel thereto, i.e. to the advancement direction (V) thereof.

A plate (482) to which a bar (483) is fixed is constrained to a branch of the belt (481), for example the lower branch.

A first bracket (484) is predisposed on the bar (483), which bracket (484) is fixed inferiorly to the second sliding guide (460) (see FIG. 3G where the second sliding guide (460) has been omitted so as to illustrate the bar (483) and the first bracket (484)).

In this way, the activating of the belt (481) determines the movement of the second sliding guide (460) with respect to the third sliding guide (470), via the sliding of the third carriage (471) along the sliding guide (470), for nearing or distancing the second cutting group (42) to/from the first cutting group (41) according to above-mentioned direction (V2), so as to adjust the position and reciprocal distance thereof on the basis of the effective position and reciprocal distance of the transversal score lines present in the cardboard sheet (F) borne by the conveyor (4).

The bar (483) advantageously has an extension and length such as to be positioned inferiorly also of the sliding guide (460') of the corresponding second cutting group (42') located on the other side of the conveyor (4), so that the bar (483) can be constrained also to the sliding guide (460') by means of a second bracket (486).

In this way, with the activating of a single belt (481) it is possible to near or distance, at the same time, the second cutting groups to or from the relative second cutting groups located on both sides of the conveyor.

Lastly, the cutting station (S2) comprises, for each of the two cutting groups (41, 42) located on both sides of the conveyor (4), a blade counter block (493) having a groove for passage of the cutting blades (411, 412; 421, 422) of the two cutting groups (41, 42), and which is arranged so as to be immediately below a respective lateral sector (SL1, SL2) of the cardboard sheet (F) located on the conveyor (4).

As indicated in the preceding, in FIGS. 2A and 2B, in relative views from above and from the side, a layout of a machine (100) for packaging an article internally of a cardboard box is illustrated, obtained from a cardboard sheet of the present invention, and comprising the cutting station (S2) described in the foregoing.

FIG. 2C and FIG. 2D schematically illustrate, in a succession of images, the various operations which the packaging machine (100) carries out starting from obtaining a cardboard sheet cut from a continuous strip of cardboard, processing the cardboard sheet so as to obtain a cardboard blank for packaging, and the operations for wrapping the cardboard blank for packaging about an article and obtaining a closed cardboard box with the packaged article inside it.

In particular, FIG. 2C illustrates, with a series of images, some main operating steps of the machine of the invention, while FIG. 2D illustrates the complete succession of all the operating steps which the machine (100) performs for packaging an article internally of a cardboard box starting from a cardboard sheet cut from a continuous strip of cardboard, which operations include realising, starting from the cut cardboard sheet, a cardboard blank (C) such as the one illustrated in FIG. 1, and folding the cardboard blank about an article so as to package it and close it internally of a cardboard box.

The operating sequences illustrated in the succession of images in FIGS. 2C and 2D have been illustrated with reference to the packaging of two articles of different shapes and dimensions, and therefore both the cardboard blanks and the final boxes obtained in the two cases have a different shape and dimension.

This is also for demonstrating how the machine (100) of the present invention is able to package and close articles internally of the relative cardboard boxes independently of the dimensions of the articles, i.e. the machine (100) realises the cardboard for packaging on the basis of the effective dimensions of the articles so that the blanks can be folded about the articles and obtain the relative boxes with the packaged and packed articles internally of the boxes.

The machine (100) comprises:

- a store (M) in which a continuous strip of cardboard (S) is predisposed, folded in bellows fashion on itself to form a fanfold (SF);
- a sectioning station (S1) of a cardboard sheet (F) from the continuous strip of cardboard (S), which sectioning station (S1) is situated downstream of the store (M), and wherein the continuous strip of cardboard (S) unwound from the fanfold (SF) is fed and advanced in an advancement direction (w) and cut so as to obtain a cardboard sheet (F) and wherein at the same time a transversal score line (T4) is realised, parallel to the cut edge on the continuous strip of cardboard (S);
- a score line forming station (S1*), downstream of the sectioning station (S1), into which the cut cardboard sheet (F) is fed, coming from the sectioning station (S1), and on which cardboard sheet (F), the two longitudinal score lines (L1, L2) are realised, so as to identify, in the cardboard sheet, a central sector (SC) and two lateral sectors (SL1, SL2); and three transversal score lines (T1, T2, T3), for identifying, in the central sector (SC), together with the score line (T4) realised previously in the sectioning station (S1), the above described five portions (P1, P2, P3, P4, P5), and wherein in the portion of cardboard sheet of the two lateral sectors (SL1, SL2), the pairs of longitudinal folding lines (a, b) (c, d) are made at the flanks of the first portion (P1), which identify the first (a1), second (a2), third (a3) and fourth (a4) folding tabs of the two lateral folding flaps (A1, A2) from which the third (C3) and the fourth (C4) lateral closing walls of the cardboard box are obtained.

In the score line forming station (S1*), the longitudinal score lines (L1, L2) and the transversal score lines (T1, T2, T3) are realised as a function of the effective dimensions of the article to be packed, in particular as a function of the dimensions of the base of the article (width L, length I) and of the height (H) of the flanks of the article.

In particular, for example, the two longitudinal score lines (L1, L2) are made at a mutual distance that is equal to the length (L) of the base of the article, the first transversal score line (T1) is made at a distance from a first transversal edge (B1) of the cardboard sheet (upstream edge with respect to the infeed direction into the score line forming station) corresponding to the height (H) of a first flank of the article, the second transversal score line (T2) is made at a distance from the first transversal score line (T1) on the basis of the width (I) of the base of the article, the third transversal score line (T3) is made at a distance from the second score line (T2) corresponding to the height (H) of the second flank of the article, opposite the first flank, and at a distance from the fourth transversal score line (T4), corresponding to the score line (T4) which had previously been realised in the sectioning station (S1), corresponding to the width (L*) of the upper face of the article.

The above-mentioned sectioning station (S1) of a cardboard sheet (F) from the continuous strip of cardboard (S) comprises: a conveyor plane (1), predisposed so as to be able to restingly receive the continuous strip of cardboard (S) which is unwound from the fanfold (F), conveying means (2), for advancing the continuous strip of cardboard (S) along the conveyor plane (1) in an advancement direction (w) and for halting the continuous strip of cardboard (S) for enabling cutting thereof, a sectioning group (3), predisposed above the conveyor plane (1), for sectioning a cardboard sheet (F) from the continuous strip of cardboard (S) and contemporaneously realise the score line (T4) in proximity of the cut edge (which will constitute the fourth score line (T4) in the cardboard sheet).

The score line forming station (S1*) comprises (FIGS. 2A, 2B):

- first score line forming means (51) predisposed to realise, on the cardboard sheet (F), two longitudinal score lines (L1, L2) parallel to the advancement direction and parallel to the longitudinal edges (BL) of the cardboard sheet (F), distanced from one another by a distance corresponding to a length (L) of the base of the article to be packed, so as to identify, in the cardboard sheet (F), a central sector (SC) and two lateral sectors (SL1, SL2) (see for example the third image starting from the left in FIG. 2D);
- second score line forming means (52) which are predisposed for realising, in the central sector (SC), the three transversal score lines (T1, T2, T3) parallel to one another and distanced so as to identify, in the central sector (SC), together with the fourth score line (T4) (which is the score line (T4) realised in the sectioning station (S1)), the above-mentioned five portions (P1, P2, P3, P4, P5) in the following way (see FIG. 1 and the fourth image starting from the left in FIG. 2D).

A first portion (P1), between the first transversal score line (T1) and the second transversal score line (T2) having dimensions corresponding to the base of the article to be packed;

- a second portion (P2), between a first transversal edge (B1) of the cardboard sheet (F) and the first transversal score line (T1), having dimensions corresponding to a first flank of the article;
- a third portion (P3), adjacent to the first portion (P1), between the second transversal score line (T2) and the third transversal score line (T3) having dimensions corresponding to a second flank of the article, opposite the first flank;
- a fourth portion (P4), between the third score line (T3) and a fourth score line (T4) (which as mentioned is the score line (T4) that has been realised in the sectioning station (S1)) having dimensions corresponding to the upper face of the article;
- and a fifth portion (P5) constituted by a strip of material of the cardboard sheet beyond the fourth transversal score line (T4) and up to the second transversal edge (B2) of the cardboard sheet (F), which will constitute the closing/opening tab (AC) of the cardboard box.

In particular, the second score line forming means (52) are predisposed for realising the three transversal score lines (T1, T2, T3) from a longitudinal edge (BL) to the other longitudinal edge (BL) of the cardboard sheet (F), so that the transversal score lines involve also the two lateral sectors (SL1, SL2) of the cardboard sheet (F).

The score line forming station (S1*) lastly further comprises third score line forming means (53) which are predisposed so as to realise, in the portions of the cardboard sheet (F) of the two lateral sectors (SL1, SL2), at flanks of the first portion (P1), pairs of longitudinal folding lines (a, b), (c, d) parallel to the two score lines (L1, L2) and having a same width extension as the first portion (P1).

The machine further comprises a transversal cutting station (S2), downstream of the score line forming station (S1*), into which the cardboard sheet (F) is fed in an advancement direction with the longitudinal score lines (L1, L2) and the four transversal score lines (T1, T2, T3, T4) and the pairs of folding lines (a, b), (c, d), into which station (S2), for each of the two lateral sectors (SL1, SL2) four transversal cuts are made on the cardboard sheet at the fourth transversal score lines (T1; T2, T3, T4), each at a relative transversal score line.

The cutting station (S2) is made according to the present invention, as described in the foregoing in detail.

The cutting station (S2) will provide, at the outlet thereof, as mentioned above, a cardboard blank for packaging (C) such as the one illustrated in the foregoing and illustrated in FIG. 1, that is, with the five portions (P1, P2, P3, P4, P5) in the central sector (SC), the six reinforcing flaps (R1, R2, R3, R4, R5, R6) in the two lateral enveloping flaps (A1, A2) in the two lateral sectors (SL1, SL2) (see also FIGS. 2C and 2D).

Downstream of this cutting station (S2), the machine (100) further comprises a successive series of work stations for carrying out the operations on the cardboard blank (C) that are necessary for realising the packing of the article internally of a box obtained from the cardboard blank.

In detail, downstream of the cutting station (S2), the machine (100) comprises, in succession one after another, a first folding station (S3), a feeding station (S3*) of the article to be packed, a second folding station (S4), for the partial folding of the cardboard blank about the article, and a closing station (S5) for the final folding of the cardboard blank about the article so as to obtain a closed cardboard box with the article inside, completely packed and packaged (see FIGS. 2A, 2B).

The first folding station (S3) is arranged downstream of the transversal cutting station (S2), into which the cardboard blank (C) is fed in an advancement direction and at which the cardboard blank (C) is halted and, simultaneously, i.e. in a single operation:

- the first (R1) and second reinforcing flap (R2) are folded, with respect to the first (L1) and the second (L2) longitudinal score line, on the second portion (P2) of the central sector (SC), for obtaining the first lateral closing wall (C1);
- the third (R3) and fourth reinforcing flap (R4), with respect to the first (L1) and the second (L2) longitudinal score line, on the third portion (P3) of the central sector (SC), for obtaining a second lateral closing wall (C2);
- the fifth (R5) and sixth reinforcing flap (R6), with respect to the first (L1) and the second (L2) longitudinal score line, on the fourth portion (P4) of the central sector (SC), for obtaining an upper closing wall (PS);
- the first folding tab (a1) of the first lateral enveloping flap (A1), with respect to the first longitudinal score line (L1), for superposing a part of the first portion (P1) of the central sector (SC) and forming a reinforcing edge and defining a third lateral closing wall (C3),
- the third folding tab (a3) of the second lateral enveloping flap (A2) is folded with respect to the second longitudinal score line (L2), for superposing on a part of the first portion (P1) of the central sector (SC) and forming a reinforcing edge and defining a fourth lateral closing wall (C4)

(see FIG. 1A, the fifth image from the left in FIG. 2C and the seventh image from the left in FIG. 2D).

As mentioned, these folding operations are carried out with the cardboard blank and simultaneously with one another, i.e. in a single action, therefore very rapidly and swiftly, requiring truly short pause times for the cardboard blank.

In this regard, the machine (100), in the first folding station (S3), comprises first folding means (63) for folding simultaneously: the first (R1) and second flap (R2), with respect to the first (L1) and the second (L2) longitudinal score line, on the second portion (P2) of the central sector (SC), for obtaining a first lateral closing wall (C1); the third (R3) and fourth reinforcing flap (R4), with respect to the first (L1) and the second (L2) longitudinal score line, on the third portion (P3) of the central sector (SC), for obtaining a second lateral closing wall (C2); the fifth (R5) and sixth flap (R6), with respect to the first (L1) and the second (L2) longitudinal score line, on the fourth portion (P4) of the central sector (SC), for obtaining an upper closing wall (PS); the first folding tab (a1) of the first lateral enveloping flap (A1), with respect to the first longitudinal score line (L1), for superposing a part of the first portion (P1) of the central sector (SC) and forming a reinforcing edge and defining a third lateral closing wall (C3), and the third folding tab (a3) of the second lateral enveloping flap (A2), with respect to the second longitudinal score line (L2), for superposing on a part of the first portion (P1) of the central sector (SC) and forming a reinforcing edge and defining a fourth lateral closing wall (C4).

At the outlet of the first folding station (S3), the cardboard blank (C) has, formed upon it, the first lateral closing wall (C1), the second lateral closing wall (C2), the upper closing wall (PS), which all have a reinforced structure thanks to the reinforcing flaps folded and partially superposed on one another, and which are on the same plane as the first portion (P1) of the cardboard blank, while the third. (C3) and fourth (C4) lateral closing wall are already partially erected and folded with respect to the central portion (P1) following the folding of the first folding tab (a1) and third folding tab (a3) above the first portion (P1), with the cardboard blank having the shape illustrated in the fifth image from the left in FIG. 2C, and also illustrated in FIG. 1B).

Downstream of this first folding station (S3), the machine (100) comprises a feeding station (S3*) of an article to be packed (see FIGS. 2A, 2B and 2D), wherein an article to be packed is deposited and rested on the first portion (P1) of the cardboard blank (C), with a first flank facing towards the first lateral closing wall (C1), a second flank, opposite the first, facing towards the second lateral closing wall (C2), a third flank, transversal to the first two, facing towards the third lateral closing wall (C3), and a fourth flank, opposite the third, facing towards the fourth lateral closing wall (C4).

At this point, the machine (100) further comprises, downstream of the inserting station of the article (S3*), a second folding station (S4) to which the cardboard blank (C) with the article rested thereon, on the first portion (P1) thereof, is fed and advanced in an advancement direction.

In the second folding station (S4), the cardboard blank (C) is advanced in the advancement direction, and while the cardboard blank (C) is in motion, at the same time (see for example the third-last image of FIG. 2C, or the pair of the flanked two third-last images of FIG. 2D):

- the third lateral closing wall (C3) is folded with respect to the folding line (a) which separates it from the first folding tab (a1) so as to cover the third flank of the article, and the second folding tab (a2) is folded with respect to the score line (b) which separates it from the third lateral closing wall (C3), so as to superpose it on a part of the upper face of the article,
- and the fourth lateral closing wall (C4) is folded with respect to the score line (c) which separates it from the third folding tab (a3) so as to cover the fourth flank of the article, and the fourth folding tab (a4) is folded with respect to the score line (d) which separates it from the fourth lateral closing wall (C4), so as to superpose it on a part of the upper face of the article.

These folding operations, as mentioned, are carried out by advancing the cardboard blank along an advancement direction, and as soon as these folding operations have been completed, the machine (100) applies glue on the second (a2) and fourth (a4) folding tabs folded onto the upper face of the article.

The machine (100) also includes, again in the second folding station (S4), and once the glue has been applied, halting the cardboard blank and (see for example the penultimate image of FIG. 2 or the pair of the two penultimate images of FIG. 2D):

rotating the second lateral closing wall (C2), with respect to the second transversal score line (T2), so as to fold it with respect to the first portion (P1) on which the article (for example folded by 90°) is rested up to when it goes to cover the second flank of the article, and then, in sequence, rotating the upper closing wall (PS), with respect to the third transversal score line (T3), so as to fold it with respect to the second lateral closing wall (C2) (for example folded by 90°) up to when it goes to cover the upper face of the article.

For this purpose, the machine (100) comprises, in this second folding station (S4) (see FIGS. 2A, 2B):

second folding means (71) for rotating the third lateral closing wall (C3), with respect to the folding line (a) which separates it from the first folding tab (a1), and folding the third lateral closing wall (C3) up to when it goes to cover the third flank of the article, and for rotating the second folding tab (a2), with respect to the score line (b) which separates it from the third lateral closing wall (C3), and folding the second folding tab (a2) up to superposing it on apart of the upper face of the article;

third folding means (72) for rotating the fourth lateral closing wall (C4), with respect to the score line (c) which separates it from the third folding tab (a3), and folding the fourth lateral closing wall (C4), up to when it goes to cover the fourth flank of the article, and for rotating the fourth folding tab (a4), with respect to the score line (d) which separates it from the fourth lateral closing wall (C4), so as to fold the fourth folding tab (a4) up to superposing it on a part of the upper face of the article;

means for applying glue (73) predisposed for applying glue on the second (a2) and fourth (a4) folding tab folded onto the upper face of the article;

blocking means (74), for blocking and halting the cardboard blank (C) once the means for applying glue (74) have applied the glue;

and fourth folding means (75) for rotating the second lateral closing wall (C2), with respect to the second, transversal score line (T2), so as to fold it with respect to the first portion (P1) on which the article is rested up to when it goes to cover the second flank of the article, and fifth folding means (76) for rotating, in succession, following the folding of the second lateral closing wall (C2), the upper closing wall (PS) with respect to the third transversal score line (T3), so as to fold it with respect to the second lateral closing wall (C2) up to when it goes to cover the upper face of the article, and therefore provide in outlet from the second folding station (S4) a cardboard box (SCA) partially closed with the packed article internally thereof.

At this point, the article is almost completely enveloped in the folded cardboard blank and the almost concluded packaging box.

The machine (100), therefore, transfers the cardboard blank (C), partly folded about the article in the above-described way, at the final closing station (S5), situated downstream of the second folding station (S4), at which the cardboard blank is halted, the first lateral closing wall (C1) is rotated with respect to the first transversal score line (T1) and folded with respect to the first portion (P1) (for example by 90°) so that it goes to cover the first flank of the article; at the same time as the folding of the first lateral closing wall (C1), glue is applied on the upper part of the first lateral closing wall (C1) (see the image on the left of the pair of last two images of FIG. 2D).

Lastly, following the completion of these operations, the machine (100), while still keeping the cardboard blank stationary in the final closing station (S5), rotates the closing tab (AC) with respect to the fourth transversal score line (T4), and folds the closing tab (AC) with respect to the upper wall (PS) (for example by 90°) against the upper part of the first lateral closing wall (C1), to make it adhere thereto and complete the closure of the cardboard box with the packaged article internally thereof (see the last image of FIG. 2C and the image on the right of the pair of two further images of FIG. 2D).

For this purpose, the machine (100), in this final closing station (S5), comprises (see FIGS. 2A, 2B):

stop means (8) activatable for halting the cardboard box (SCA);

sixth folding means (81) predisposed for being activated once the box (SCA) has been halted for rotating the first lateral closing wall (C1), with respect to the first transversal score line (T1), so as to fold it with respect to the first portion (P1) on which the article is rested so that it goes to cover the first flank of the article;

a glue applying organ (82), functionally associated to the sixth folding means (81), and predisposed for applying glue on a part of the first lateral closing wall (C1) while it is folded by the sixth folding means (81) against the first flank of the article, and seventh folding means (83) activatable for rotating the closing tab (AC) with respect to the fourth transversal score line (T4), and folding the closing tab (AC) with respect to the upper wall (PS) against the upper part of the first lateral closing wall (C1) on which the glue had been applied, in order to make it adhere thereto and complete the closing of the cardboard box (SCA) with the article packed internally thereof, and thus provide at the outlet of the final closing station (S5) a cardboard box (SCA) completely closed with the packed article internal thereof.

The machine (100) then transfers the cardboard box, with the packaged article inside, to the outlet of the final closing station (S5), so that the cardboard box can be collected and directed towards a station for management and dispatch of orders.

The machine (100) further comprises, between the cutting station (S2) and the first folding station (S3), also a trimming station (S2*), in which the cardboard blank can be trimmed along the longitudinal edges so as to adapt the width of the reinforcing flaps (R1, R2, R3, R4, R5, R6) to the effective dimensions of the second (P2), third (P3) and fourth portion (P4), so that the reinforcing flaps can effectively be folded above the portions, and at least partially superposed on one another, so as to adapt the width of the two lateral folding flaps (A1, A2), to the effective dimension of the third flank and fourth flank of the article. The machine (100) also comprises, again between the cutting station (S2) and the first folding station (S3), downstream of the trimming station (S2*), a glue applying station (S2) comprising means for applying glue at least on reinforcing flaps (R1, R2, R3, R4, R5, R6) and/or on the second portion (P2), third portion (P3) and fourth portion (P4), on which the reinforcing flaps (R1, R2, R3, R4, R5, R6) have to be folded in the following first folding station (S3**).

The invention claimed is:

1. A cutting station for making transversal cuts in a cardboard sheet, comprising an inlet and an outlet and predisposed to receive at the inlet thereof the cardboard sheet having two transversal edges and two longitudinal edges and comprising two longitudinal score lines, from a first of the two transversal edges to a second of the two transversal edges, and four transversal score lines from one of the longitudinal edges to the other of the longitudinal edges, the two longitudinal score lines being parallel to one another and parallel to the two longitudinal edges and at a reciprocal distance from one another corresponding to the length of a base of an article to be packaged and packed with the cardboard sheet, and defining, in the cardboard sheet, a central sector, between the two longitudinal score lines, and two lateral sectors externally of the two longitudinal score lines, the four transversal score lines being parallel to one another and parallel to the two transversal edges, and which comprise, starting from the first of the two transversal edges of the cardboard sheet:

a first transversal score line at a distance from the first of the two transversal edges of the cardboard sheet corresponding to a height of a first lateral flank of the article to be packaged and packed with the cardboard sheet;

a second transversal score line at a distance from the first score line corresponding to a width of the base of the article;

a third transversal score line at a distance from the second transversal score line corresponding to a height of a second flank of the article, parallel and opposite the first flank;

a fourth transversal score line at a distance from the third score line corresponding to a width of an upper face of the article to be packed;

the cardboard sheet received at the inlet of the cutting station having, in the central sector, five portions defined by the four transversal score lines and comprising:

a first portion, between the first transversal score line and the second transversal score line;

a second portion, between a first transversal edge of the cardboard sheet and the first transversal score line, adjacent to the first portion and hinged thereto by means of the first transversal score line;

a third portion, between the second transversal score line and the third transversal score line, adjacent to the first portion and hinged thereto by means of the second transversal score line;

a fourth portion, between the third transversal score line and the fourth transversal score line, adjacent to the third portion and hinged thereto by means of the third transversal score line; and a fifth portion between the fourth transversal score line and the second transversal edge of the cardboard sheet, the cutting station comprising:

a conveyor which extends from the inlet to the outlet and which is configured to support the cardboard sheet, with the first transversal edge, and therefore the first transversal score line, being arranged upstream of and transversal to the conveyor, and the second transversal edge, and therefore the fourth transversal score line being arranged downstream of and transversal to the conveyor and with the two longitudinal edges parallel to the conveyor, the conveyor being dimensioned and predisposed so that the cardboard sheet is arranged thereon resting with at least a part of the central sector thereof, and with the two lateral sectors projecting laterally beyond the two sides of the conveyor, the conveyor being activatable for conveying and transporting the cardboard sheet from the inlet to the outlet in an advancement direction;

the cutting station further comprising, for each, and at a flank of each, of the two sides of the conveyor, a first cutting group and a second cutting group, which are predisposed and configured for making transversal cuts on a respective lateral sector of each of the two lateral sectors of the cardboard sheet and wherein:

the first cutting group is arranged downstream of the second cutting group with respect to the advancement direction of the conveyor;

the first cutting group and the second cutting group are predisposed by a flank of each of the two sides of the conveyor so as to be translatable, contemporaneously, alternatively in a perpendicular and transversal direction to the conveyor, and therefore so as to be both approximated to or distanced from the conveyor, so as to enable adjustment of the position thereof on a basis of an actual position and dimension of the two lateral sectors projecting laterally from the conveyor;

the second cutting group is predisposed so as to be translatable with respect to the first cutting group, alternatingly in a parallel direction to the conveyor, in such a way that the second cutting group can approximate or separate from the first cutting group so as to enable adjustment of the position and distance thereof with respect to the first cutting group on a basis of an actual reciprocal distance existing between two adjacent transversal score lines;

the conveyor is activatable for advancing the cardboard sheet in the advancement direction and to halt the cardboard sheet in a first position at which the fourth transversal score line is situated below the first cutting group, so as to enable the second cutting group to translate with respect to the first cutting group so as to adjust the position thereof and distance therefrom on a basis of the actual distance present between the third transversal score line and the fourth transversal score line so that the second cutting group is positioned above the third transversal score line and therefore, consequently, to enable the first cutting group to make a cut in the respective lateral sector of each of the two lateral sectors at the fourth transversal score line and to enable the second cutting group to make a cut in the respective lateral sector at the third transversal score line, the conveyor being further activatable to further advance the cardboard sheet in the advancement direction up to halting the cardboard sheet in a second position at which the second transversal score line is positioned below the first cutting group, so as to enable the second cutting group to be translated with respect to the first cutting group so as to adjust the position thereof and distance therefrom on a basis of the actual distance present between the first transversal score line and the second transversal score line so that the second cutting group is positioned above the first transversal score line and therefore, consequently, to enable the first cutting group to make a cut in the respective lateral sector at the second transversal score line and to enable the second cutting group to make a cut in the respective lateral sector at the first transversal score line, the cutting station additionally comprising:

activating means of the first cutting group and the second cutting group, the activating means comprising a shaft extending parallel to the conveyor and activatable in rotation, the first cutting group comprising a pair of cutting blades which are mounted on the shaft at 180° to one another and arranged perpendicular and transversal to the conveyor, the second cutting group in turn comprising a pair of cutting blades which are also mounted on the shaft at 180° to one another and arranged perpendicular and transversal to the conveyor, the pair of blades of the first cutting group and the pair of blade of the second cutting group being mounted on the common shaft so as to have a same angular orientation with respect to the shaft; and a first frame and a second frame, the first cutting group being borne by the first frame and second cutting group being borne by the second frame;

a first sliding guide which is arranged so as to be transversal and perpendicular to the conveyor; and a second sliding guide which is arranged parallel to the first sliding guide, and therefore transversal and perpendicular to the conveyor, the first frame being mounted slidably on the first sliding guide and the second frame being mounted slidably on the second sliding guide.

2. The cutting station of claim 1, wherein the first frame is mounted on a first carriage which is coupled slidably to the first sliding guide, and wherein the second frame is mounted on a second carriage which is coupled slidably to the second sliding guide.

3. The cutting station of claim 1, further comprising first movement means which are configured and predisposed so as to alternatively translate the first frame, with respect to the first sliding guide, and thus to alternatingly translate the first cutting group with respect to the first sliding guide and the second cutting group with respect to the second sliding guide in such a way as approximate the first cutting group and the second cutting group to or distance the first cutting group and the second cutting group from the conveyor, in order to adjust the position thereof to the actual position and dimension of the lateral sectors of the cardboard sheet which project from the sides of the conveyor.

4. The cutting station of claim 1, further comprising a third sliding guide which is arranged parallel to the conveyor and therefore transversal and perpendicular to the first sliding guide and to the second sliding guide, the second sliding guide being coupled to the third sliding guide and predisposed so as to be a slidable, and therefore translatable, with respect to the third sliding guide so as to enable translation of the second cutting group with respect to the first cutting group, to move the second cutting group closer to or farther from the first cutting group, so as to adjust the position and distance of the second cutting group with respect to the first cutting group on a basis of an actual reciprocal distance of two adjacent transversal score lines present in the lateral sector of the cardboard sheet.

5. The cutting station of claim 4, further comprising second movement means which are predisposed to move and slide the second sliding guide with respect to the third sliding guide.

6. The cutting station of claim 5, further comprising a third carriage which is predisposed at an extreme part of the second sliding guide and is slidably coupled to the third sliding guide.

7. The cutting station of claim 1, wherein the activating means of the two cutting groups comprise a motor for activating the shaft in rotation, on which shaft the two pairs of blades of each of the two cutting groups are mounted, the motor being mounted on a respective frame which is borne by a fourth carriage mounted slidably on a fourth sliding guide which is predisposed so as to be parallel to the first sliding guide and to the second sliding guide, therefore transversal and perpendicular to the conveyor.

8. The cutting station of claim 3, wherein the first movement means comprise a belt which is loop-wound on respective pulleys, of which at least a drive pulley for activating the belt, the pulleys being arranged so that the belt is arranged transversal and perpendicular to the conveyor and to the advancement direction of the conveyor, and in that the first frame bearing the first cutting group is constrained by means of a clamp to a branch of the belt.

9. The cutting station of claim 5, wherein the second movement means in turn comprise:

a belt which is loop-wound on respective pulleys, of which at least a drive pulley, the pulleys being arranged so that the belt is arranged below the conveyor and parallel thereto and to the advancement direction thereof;

a plate, constrained to a branch of the belt;

a bar which is fixed to the plate; and a bracket which is predisposed on the bar and which is constrained and fixed inferiorly to the second sliding guide.

10. The cutting station of claim 1, further comprising, for each of the two cutting groups located on both sides of the conveyor, a blade counter block having a groove for passage of the cutting blades of the two cutting groups, arranged so as to be immediately below a respective lateral sector of the cardboard sheet located on the conveyor.

11. A machine for packing an article internally of a cardboard box obtained from a cardboard sheet, comprising:

(a) a store in which a continuous strip of cardboard is predisposed, folded on itself to form a fanfold;

(b) a sectioning station of a cardboard sheet from the continuous strip of cardboard, which sectioning station is situated downstream of the store, comprising: (i) a conveyor plane, predisposed so as to be able to restingly receive the continuous strip of cardboard which is unwound from the fanfold, conveying means, for advancing the continuous strip of cardboard along the conveyor plane in an advancement direction and for halting the continuous strip of cardboard for enabling cutting thereof, and (ii) a sectioning group, predisposed above the conveyor plane, for sectioning a cardboard sheet from the continuous strip of cardboard and at the same time making a first transversal score line, parallel to the cut edge on the continuous strip of cardboard;

(c) a score line forming station, downstream of the sectioning station, into which the cut cardboard sheet is fed, coming from the sectioning station, and advanced in an advancement direction, comprising:

first score line forming means predisposed to make, on the cardboard sheet, two longitudinal score lines parallel to the advancement direction and parallel to the longitudinal edges of the cardboard sheet, distanced from one another by a distance corresponding to a length of the base of the article to be packed, so as to identify, in the cardboard sheet, a central sector and two lateral sectors;

second score line forming means that are predisposed for making second, third and fourth transversal score lines parallel to one another, and parallel to the first transversal score line and distanced so as to define, in the central sector, together with the first transversal score line, five portions:

a first portion, between the first transversal score line and the second transversal score line having dimensions corresponding to the base of the article to be packed;

a second portion, between a first transversal edge of the cardboard sheet and the first transversal score line, having dimensions corresponding to a first flank of the article;

a third portion, adjacent to the first portion, between the second transversal score line and the third transversal score line having dimensions corresponding to a second flank of the article, opposite the first flank;

a fourth portion, between the third transversal score line and the fourth transversal score line, having dimensions corresponding to the upper face of the article; and a fifth portion constituted by a strip of material of the cardboard sheet between the fourth transversal score line and a second transversal edge of the cardboard sheet; and third score line forming means which are predisposed so as to make, in the portions of the cardboard sheet of the two lateral sectors, at flanks of the first portion, pairs of longitudinal folding lines parallel to the two longitudinal score lines and having a same width extension as the first portion, (d) a cutting station, downstream of the score line forming station, into which the cardboard sheet is fed in an advancement direction with the two longitudinal score lines in the central sector and the first, second, third, and fourth transversal score lines and the pairs of folding lines, in the two lateral sectors, the cutting station being configured for carrying out four transversal cuts for each of the two lateral sectors of the cardboard sheet, at the four transversal score lines, so as to obtain:

at the two ends of the second portion, a first reinforcing flap and a second reinforcing flap;

at the two ends of the first portion, a first lateral enveloping flap, containing the first pair of longitudinal folding lines which identify a first folding tab between the folding line and the first longitudinal score line, and a second folding tab between the folding line and the edge of the first enveloping flap, and a second lateral enveloping flap, containing the second pair of longitudinal folding lines which identify a third folding tab, between the folding line and the second longitudinal score line and a fourth folding tab between the folding line and the edge of the second enveloping flap;

at the two ends of the third portion, a third reinforcing flap and a fourth reinforcing flap; at the two ends of the fourth portion, a fifth reinforcing flap and a sixth reinforcing flap; and the cutting station being further configured for forming, between the fourth transversal score line and the second transversal edge, a tab for closing the cardboard box, so as to provide, at the outlet of the cutting station, a cardboard blank for packing the article;

(e) a first folding station, downstream of the cutting station, into which the cardboard blank is fed in an advancement direction and in which the cardboard blank is halted and comprising first folding means (i) for folding simultaneously:

the first and second reinforcing flap, with respect to the first and the second longitudinal score line, on the second portion of the central sector, for obtaining a first lateral closing wall;

the third and fourth reinforcing flap, with respect to the first and the second longitudinal score line, on the third portion of the central sector, for obtaining a second lateral closing wall;

the fifth and sixth reinforcing flap, with respect to the first and the second longitudinal score line, on the fourth portion of the central sector, for obtaining an upper closing wall; and the first folding tab of the first lateral enveloping flap, with respect to the first longitudinal score line, (ii) for superposing a part of the first portion of the central sector and forming a reinforcing edge and defining a third lateral closing wall, and the third folding tab of the second lateral enveloping flap, with respect to the second longitudinal score line, (iii) for superposing a part of the first portion of the central sector and forming a reinforcing edge and defining a fourth lateral closing wall, a feeding station of the article to be packed, to which the cardboard blank coming from the first folding station is fed and wherein the article to be packed is deposited and rested on the first portion of the cardboard blank, with a first flank facing towards the first lateral closing wall, a second flank, opposite the first, facing towards the second lateral closing wall, a third flank, transversal to the first two, facing towards the third lateral closing wall, and a fourth flank, opposite the third, facing towards the fourth lateral closing wall;

(f) a second folding station to which the cardboard blank with the article rested thereon, on the first portion thereof, is fed and advanced in an advancement direction, comprising:

second folding means for rotating the third lateral closing wall, with respect to the folding line which separates the third lateral closing wall from the first folding tab, and folding the third lateral closing wall up to when the third lateral closing wall goes to cover the third flank of the article, and for rotating the second folding tab, with respect to the folding line which separates the second folding tab from the third lateral closing wall, and folding the second folding tab up to superposing the second folding tab on a part of the upper face of the article;

third folding means for rotating the fourth lateral closing wall, with respect to the folding line which separates the fourth lateral closing wall from the third folding tab, and folding the fourth lateral closing wall up to when the fourth lateral closing wall goes to cover the fourth flank of the article, and for rotating the fourth folding tab, with respect to the folding line which separates the fourth folding tab from the fourth lateral closing wall, so as to fold the fourth folding tab up to superposing the fourth folding tab on a part of the upper face of the article;

means for applying glue predisposed for applying glue on the second and fourth folding tab folded onto the upper face of the article;

blocking means, for blocking and halting the cardboard blank once the means for applying glue have applied the glue;

fourth folding means for rotating the second lateral closing wall, with respect to the second transversal score line, so as to fold the second lateral closing wall with respect to the first portion on which the article is rested up to when the second lateral closing wall goes to cover the second flank of the article, and fifth folding means for rotating, in succession, the upper closing wall with respect to the third transversal score line, so as to fold the upper closing wall with respect to the second lateral closing wall up to when the upper closing wall goes to cover the upper face of the article, and therefore provide in outlet from the second folding station a cardboard box partially closed with the packed article internally thereof;

(g) a final closing station, situated downstream of the second folding station, to which the partially-closed cardboard box is fed, and comprising:

stop means activatable for halting the cardboard box;

sixth folding means predisposed for being activated once the box has been halted and for rotating the first lateral closing wall, with respect to the first transversal score line, so as to fold the first lateral closing wall with respect to the first portion on which the article is rested so that the first lateral closing wall goes to cover the first flank of the article;

a glue applying organ, functionally associated to the sixth folding means, and predisposed for applying glue on a part of the first lateral closing wall while the first lateral closing wall is folded by the sixth folding means against the first flank of the article, and seventh folding means activatable for rotating the closing tab, with respect to the fourth transversal score line, and for folding the closing tab with respect to the upper wall against the upper part of the first lateral closing wall on which the glue had been applied, in order to make the closing tab adhere thereto and complete the closing of the cardboard box with the article packed internally thereof, in order to provide at the outlet of the final closing station a cardboard box completely closed with the packed article internal thereof.

12. The machine of claim 11 wherein the cutting station comprises:

an inlet and an outlet and predisposed to receive at the inlet thereof the cut cardboard sheet;

a conveyor which extends from the inlet to the outlet and which is able to restingly receive the cardboard sheet, with the first transversal edge and the first transversal score line being arranged upstream of and transversal to the conveyor, and with the second transversal edge and the fourth transversal score line being arranged downstream of and transversal to the conveyor and with the two longitudinal edges parallel to the conveyor, the conveyor being dimensioned and predisposed so that the cardboard sheet is arranged thereon resting with at least a part of the central sector thereof, and with the two lateral sectors projecting laterally beyond the two sides of the conveyor, the conveyor being activatable for conveying and transporting the cardboard sheet from the inlet to the outlet in an advancement direction; and at a flank of each, of the two sides of the conveyor, a first cutting group and a second cutting group, which are predisposed and configured for making transversal cuts on a respective lateral sector of each of the two lateral sectors of the cardboard sheet, wherein:

the first cutting group is arranged downstream of the second cutting group with respect to the advancement direction of the conveyor;

the first cutting group and the second cutting group are predisposed by a flank of each of the two sides of the conveyor so as to be able to be translated, contemporaneously, alternatively in a perpendicular and transversal direction relative to the conveyor, and therefore so as to be both approximated to or distanced from the conveyor, so as to be able to adjust the position thereof on a basis of an actual position and dimension of the two lateral sectors projecting laterally from the conveyor;

the second cutting group is predisposed so as to be able to be translated with respect to the first cutting group, alternatingly in a parallel direction to the conveyor, in such a way that the second cutting group can be neared to or distanced from the first cutting group so as to be able to adjust the position and distance thereof with respect to the first cutting group on a basis of an actual reciprocal distance existing between two adjacent transversal score lines;

the conveyor is activatable for advancing the cardboard sheet in the advancement direction and to halt the cardboard sheet in a first position at which the fourth transversal score line is situated below the first cutting group, so as to enable the second cutting group to be translated with respect to the first cutting group so as to adjust the position thereof and distance therefrom on a basis of the actual distance present between the third transversal score line and the fourth transversal score line so that the second cutting group is positioned above the third transversal score line and therefore, consequently, to enable the first cutting group to make a cut in the respective lateral sector of each of the two lateral sectors at the fourth transversal score line and to enable the second cutting group to make a cut in the respective lateral sector at the third transversal score line, the conveyor being further activatable to further advance the cardboard sheet in the advancement direction up to halting in a second position at which the second transversal score line is positioned below the first cutting group, so as to enable the second cutting group to be translated with respect to the first cutting group so as to adjust the position thereof and distance therefrom on a basis of the actual distance present between the first transversal score line and the second transversal score line so that the second cutting group is positioned above the first transversal score line and therefore, consequently, to enable the first cutting group to make a cut in the respective lateral sector at the second transversal score line and to enable the second cutting group to make a cut in the respective lateral sector at the first transversal score line.

* * * * *